US012630328B2

(12) United States Patent
Melrose et al.

(10) Patent No.: US 12,630,328 B2
(45) Date of Patent: May 19, 2026

(54) PLASTIC CONTAINER HAVING AN INTERACTIVE PCR CHANNEL STRUCTURE AND MOVEABLE BASE

(71) Applicant: CO2PAC Limited, Auckland (NZ)

(72) Inventors: David Murray Melrose, Auckland (NZ); Campbell Melrose-Allen, Auckland (NZ)

(73) Assignee: CO2PAC Limited, Auckland (NZ)

( * ) Notice: Subject to any disclaimer, the term of this patent is extended or adjusted under 35 U.S.C. 154(b) by 0 days.

(21) Appl. No.: 18/988,072

(22) Filed: Dec. 19, 2024

(65) Prior Publication Data

US 2025/0206491 A1 Jun. 26, 2025

(30) Foreign Application Priority Data

Dec. 22, 2023 (NZ) ..... 807002

(51) Int. Cl.
*B65D 1/02* (2006.01)
*B65D 1/44* (2006.01)
*B65D 81/20* (2006.01)

(52) U.S. Cl.
CPC ..... *B65D 1/0284* (2013.01); *B65D 1/44* (2013.01); *B65D 81/2015* (2013.01)

(58) Field of Classification Search
CPC ..... B65D 1/44; B65D 1/0284; B65D 1/0261; B65D 1/0223; B65D 1/0246; B65D 1/023; B65D 11/24; B65D 11/22; B65D 11/20; B65D 79/0081; B65D 79/008; B65D 79/005; B65D 81/2015; B65D 81/2007; B65D 81/20
USPC ..... 215/381, 382, 375, 374, 373, 372; 220/675, 669, 609, 608, 604
See application file for complete search history.

(56) References Cited

U.S. PATENT DOCUMENTS

| | | | | |
|---|---|---|---|---|
| 6,277,321 | B1 | 8/2001 | Vailliencourt et al. | |
| 10,059,482 | B2 * | 8/2018 | Mast | B65D 1/0276 |
| 10,279,530 | B2 | 5/2019 | Schneider et al. | |
| 10,435,223 | B2 * | 10/2019 | Melrose | B65D 1/0276 |
| 10,538,357 | B2 | 1/2020 | Lane et al. | |
| 11,377,287 | B2 | 7/2022 | Melrose et al. | |

(Continued)

*Primary Examiner* — Robert J Hicks
(74) *Attorney, Agent, or Firm* — Rothwell, Figg, Ernst & Manbeck, P.C.

(57) ABSTRACT

The disclosure relates to a beverage container. Channels of the container can have a first as molded channel configuration formed in and extending around a circumference of a sidewall of the container and can be configured to resist vacuum compression in the radial or transverse direction of the container. After hot filling and capping and prior to cooling, the sidewall and base can be configured to move interactively and in differential amounts under changing pressure conditions. The sidewall can be configured to expand longitudinally from a first unpressurized configuration to a second pressurized configuration, and the base portion can be configured to move to a different extent longitudinally from a first unpressurized configuration to a second pressurized configuration. After cooling, the sidewall can be configured to contract longitudinally to a third pressurized configuration, and the base can be configured to move to a different extent to a third pressurized configuration.

19 Claims, 18 Drawing Sheets
(5 of 18 Drawing Sheet(s) Filed in Color)

(56) References Cited

U.S. PATENT DOCUMENTS

| | | | | |
|---|---|---|---|---|
| 11,891,227 | B2 | 2/2024 | Lane et al. | |
| 11,912,459 | B2 | 2/2024 | Howell et al. | |
| 2006/0255005 | A1* | 11/2006 | Melrose | B65D 1/46 215/381 |
| 2010/0213204 | A1* | 8/2010 | Melrose | B65B 31/00 220/721 |
| 2019/0291935 | A1* | 9/2019 | Melrose | B67C 3/045 |
| 2021/0221593 | A1 | 7/2021 | Lane et al. | |

* cited by examiner

Detail G

First Configuration
As molded

Second Configuration
Hot Filled and Capped
prior to cooling

Third Configuration
Post Cooling

6. Extraction 27.8 ml at 3.0 psi (Distribution) 4C/39F after 6 -12 months

Instep Height/Width
2.19:6.26
=1:2.85

Detail G

TOTAL AREA
4430 mm2

TOTAL AREA
4511 mm2

WEB AREA
1295 mm2

FOOT AREA
3216 mm2

TOTAL AREA
4603 mm2

WEB AREA
2660 mm2

FOOT AREA
1942.8 mm2

PLASTIC CONTAINER HAVING AN INTERACTIVE PCR CHANNEL STRUCTURE AND MOVEABLE BASE

BACKGROUND

Field

The present invention generally relates to a pressure-adjustable container, and more particularly to such containers that are typically made of polyester and are capable of being filled with hot liquid. The present invention relates generally to polymer compositions having increased recycled content, or percentage of post-consumer resin (PCR), for use in preforms and beverage containers and the described embodiments may increase the ability of a hot-fill container structure to accommodate and regulate the forces encountered during processing that could otherwise result in variable height or variable performance containers presented for distribution. The present invention also relates to methods of making and processing containers having an increased percentage of post-consumer resin (PCR) and flexible or invertible vacuum panels set into the base of the container.

Description of Related Art

As disclosed in U.S. Pat. No. 6,277,321—incorporated herein by reference in its entirety —, as containers made of polyethylene terephthalate (PET), or other plastic resins which are capable of being used in hot-fill applications become more widespread, there is a need to develop these hot-fill containers so as to be suitable for an ever wider variety of product applications. In general, heat-set or hot-fill containers are capable of receiving a product therein while the product is at an elevated temperature, without any resulting deformation in the container. Containers of this variety are used in those situations where the product needs to be sterilized, pasteurized or otherwise heat treated prior to filling. Upon the introduction of the hot product into the container, if the container is not of a hot-fill variety, stresses in the material forming the container will cause the container to deform into an unacceptable end product. To be considered a hot-fill container, containers must be capable of withstanding filling temperatures of at least 150° Fahrenheit (F). and more typically 160°-180° F.

In forming a hot-fill container, PET or another suitable plastic resin is initially formed into a preform. This is most often done by an injection molding method. Preforms all have a protypical structure which includes a mouth and a generally tubular body that terminates in a closed, typically rounded, end. Prior to being formed into containers, preforms in a softened state through the application of heat are transferred into a mold cavity configured in the shape of the desired container. Once in the mold cavity, the heated preforms are blow molded or stretch-blow molded into the desired container shape.

During the blow molding process, the plastic material is stretched and expanded so as to introduce an orientation (on the molecular level) into the material. The amount and location of orientation imparts various mechanical properties to the container. Generally, the higher the orientation, the less the container is capable of withstanding hot-fill temperatures. To increase the hot-fill capabilities of these oriented containers, the containers must be subsequently heat treated. The heat treatment, which can be one of several known methods, increases the crystallinity of the material forming the container and this results in an increase in the container's thermal capabilities.

Once heat-set during the molding process, the container is then filled with a heated liquid and capped in a so called "Hot-fill" process.

However, Hot-fill applications impose significant and complex mechanical stress even on the structure of a heat-set plastic container due to thermal stress, hydraulic pressure upon filling and immediately after capping the container, and vacuum pressure as the fluid cools. This is particularly so if the plastic material is comprised of a proportion of Post Consumer Resin (PCR) or recycled material.

Thermal stress is firstly applied to the walls of the container upon introduction of hot fluid. The hot fluid causes the container walls to first soften and then shrink unevenly, causing distortion of the container. As stated above, the plastic material (e.g., polyester) must, therefore, be heat-treated to induce molecular changes resulting in a container that exhibits increased thermal stability, however in the presence of PCR within the material there is a limitation on the thermal stability of the container.

The thermal stress varies according to the filling method used. For example, typical 'neck support' fillers where the container is held by the neck-support transfer ring during the filling period may apply different thermal stress to a container prior to capping or sealing the container, than do typical 'base-support' fillers—where the container is supported by the contact surface of the base during the filling cycle prior to capping and sealing. The variable thermal stress applied to the containers between such filling methods may induce a corresponding variation in the height of the bottles during processing of the container unless the container sidewall structures are specifically designed to resist or regulate these variable thermal stresses as described in the present invention.

As container sidewalls are light-weighted, this variable stress becomes even more apparent and there is a need for more complex sidewall structures to resist and/or to regulate or ameliorate the variable filling stresses.

Most importantly, pressure and stress not only act upon the sidewalls of a heat resistant container during the filling process, but also act upon the base portion for a significant period of time thereafter. When the container is filled with hot fluid and sealed, there is an initial and variable thermal stress on the container as described above. Additional to this, there is often a variable top load applied to the containers during the filling cycle, for various reasons, to further complicate the stresses being applied to the containers.

In the case of typical neck support fillers there may be little, or no, vertical downward or compressive force applied to the sidewalls during the filling period and prior to capping. The container hangs by the neck support ring and with the introduction of the heated fluid there is a hydrostatic pressure applied to the sidewalls of the container exerted by the weight of the heated fluid-due to the force of gravity within the open container prior to sealing or capping.

If the filling temperature is above approximately 75 degrees Celsius (C), the hot fluid causes the plastic in the sidewalls and base portion to enter a 'glass transition state' and the sidewalls and base become soft, malleable, and are readily subjected to deformation in the presence of both downward and radial forces.

Such downward and radial forces are exerted on the container during filling, and in variable ways according to the fill method. Downward internal force from the weight of hot liquid in a container may then cause the moveable panel to expand in length along the longitudinal aspect, and to do so uncontrollably and thereby become compromised in function. In detail, all structures within the base and sidewall may be vulnerable to deformation, either in the radial or transverse planes, and also in the longitudinal direction.

The expansion forces applied to the hot container walls during a typical neck support filler may be further amplified if the filler does not properly 'vent' the neck opening during the filling cycle. For example, if the hot liquid contents are introduced under any effective hydraulic loading pressure, such as might occur when the neck is closed off to an extent during filling-causing a rise in internal pressure within the container during the filling cycle. The internal hydraulic pressure will also be applied to the inside of the container in addition to the hydrostatic pressure being applied by the simple weight of the product itself. This increase of internal force against the base and sidewall while the container is temporarily exposed to hydraulic pressure causes further expansion stresses being applied to the walls of the container in both the outward radial and outward longitudinal extents.

These forces can result in significant 'stretching' of the container, resulting in a container that is no longer a correct size or height and cannot return to the correct design height, due to non-returnable deformation for example. If incorrect height containers are subsequently packed together with correctly-sized containers then significant problems can occur, for example in palletization of mixed sized containers, where the different load heights may become very unstable and dangerous in a typical warehouse situation.

Further problems can arise in a number of situations if heights of containers are not controlled properly, for example in container vending machines, where the heights of the containers must be kept the same, or within very tight tolerances, or wrong sized containers may not vend properly or become 'stuck' in the vending machine.

Alternatively, a container may be filled by a typical base support filler that may in fact apply significantly different forces during the hot side of the filling cycle than are exerted by a neck support filler. When being filled in this alternative manner the container may instead have a downward and compressive top load applied directly to the neck of the container during the filling period. This downward compressive force is not countered by the support mechanism found in a neck support filler unless additional neck support guides are included in the base support filler and adjusted closely to avoid increased longitudinal compression or top load while the container is hot and 'vented'. This may result in load being applied directly downward along the heated container sidewalls. This force is then contained by the standing ring of the container and directed across the transverse base.

These forces are very different to the internal and expansionary forces encountered in the neck support filler described above. If a container is effectively mechanically compressed in height under base support fill, or if any downward load is applied to the neck finish during the fill cycle or capping cycle and the base is supported on a base plate or conveyor mechanism (as opposed to hanging free in the air as encountered in a neck support filler), then compressive forces may be applied to the heated sidewalls of the container causing a non-returnable reduction in height of the container simultaneously with the sidewalls exceeding glass transition temperature (Tg) and this may result in a 'forced' shortening or lowering in height of the sidewalls and container.

This lowering in height potential by base support fillers, when compared to an increase in height potential by neck support fillers, results in height differentials between containers manufactured to the same specifications off the same blow-molder, but then processed on the different filling systems. There may be large variations in height in containers hot filled and processed on a base support system, where containers are shortened, to containers hot filled and processed on a neck support or hang system, where containers are stretched or lengthened in height.

As discussed above, the application of such variable longitudinal forces, depending on the fill methods, causes variable longitudinal stretching or compression and differing internal force against the base panel of the container, that in turn causes variable deformation in moveable base panels. Such stresses are significantly affected by the thickness of the plastic material. The lighter or thinner the material, then the worse the potential and occurrence for permanent stretching of the base panel or base panel roll-out.

Base roll-out of moveable or invertible base panels can result in the panel no longer functioning properly as designed when the container is cooled and a vacuum pressure builds up. A stretched or deformed base panel may no longer move as intended and may not assist in vacuum accommodation as designed. This is a severe problem for an industry committed to light-weighting plastic bottles to reduce overall quantities of plastic being processed.

Additionally, any increase in post-consumer resin (PCR), or recycled PET (rPet) causes increased problems in the base panel. The mechanical strength of the container sidewalls and base may be significantly altered with increased amounts of PCR.

Therefore, increasing recycled plastic content or post-consumer resin (PCR) has particular impact on lightweight moveable bases compared to traditional 'hot fill' bases that are internally recessed to a strong degree, are structured to mostly resist or avoid any movement outwardly, and are composed of thick slugs of plastic.

The use of rigidifying or stabilizing structures on the sidewall of a container becomes compromised as increased use of PCR is utilized. Recycled PET containers may include a higher copolymer content. But hot-fill containers with rPET content may typically lower the crystallinity of the hot-fill container, as recycled content effectively increases the copolymer content, thereby suppressing crystallinity in bottle walls and base. This may create challenges during hot filling containers having annular ribbings or the like in the sidewall because the crystallinity levels need to ensure that the container maintains its shape during the elevated filling temperatures of a hot-fill process. If crystallinity levels are suppressed, the resulting container may not be as strong as desired or may deform at the elevated temperatures required for hot filling. For example, increased recycled content may undesirably reduce sidewall or base stiffness or rigidity. Accordingly, containers with sidewalls having a higher recycled content—and corresponding lower crystallinity—may be more prone to distortion.

Several problems exist with the addition of horizontal ribbings, however, particularly in the presence of light-weighting and/or increased use of PCR within material compositions. Container designs prone to stretching may stretch even more than anticipated, and container designs prone to compression (lack of top load) may alternatively compress even more than anticipated. This results in much greater differentials between container heights blow-molded to the same specifications.

Once the container has been filled by either a neck support or base support filling system, the height of lightweight containers having even 20-25% PCR content, the heights of the containers may be variably compromised due to weakening of horizontal ribs in the sidewalls and increased base roll-out in the base. Subsequently during processing, the container of either filling system is then passed to a capping unit and sealed, and it is then placed on the conveyor belt of the filling line. Additional downward force may be applied during the capping phase that further compresses a container in height briefly unless there is 100% neck support available to the container neck support ring during this time. Such additional downward pressure may cause a rise in internal pressure within the container that applies additional force to the base panel.

Following capping, the sealed liquid contents are then used to sterilize the internal surfaces of the container and cap. This process generally requires the closed container to be inverted or laid horizontally on its side for a brief period, followed by a short holding time of approximately one further minute prior to placing the container in a cooling unit that begins to lower the temperature of the sidewalls first, followed by a gradual reduction in internal container temperature.

This period on the 'hot side' of the processing cycle is generally shared in execution technique between both base support and neck support systems, with both systems utilizing a base support system during conveyor transport. However, during this post-capping period further internal force is applied to the hot sidewalls of the container, generally evenly shared in force between the systems. There is a period of sustained pneumatic pressure created within the headspace of the sealed container, as a result of the air in the headspace expanding under the heat of the contents, but being restrained by the seal or cap. This pneumatic pressure contributes to a rise in internal pressure that results in an expansionary force longitudinally within the container. This force may further stretch the container longitudinally.

Another force is also added to this pneumatic pressure. The plastic sidewalls generally attempt to contract radially inwardly and return by memory to their original preform size and shape. This 'contraction' or shrinking of the sidewalls is prevented by the presence of the sealed container capping the liquid. The hot liquid during this period of processing is largely incompressible until it is cooled and brought down in temperature, whereby the liquid may then contract in size. The sidewalls therefore exert a hydraulic pressure against the headspace within the container. This hydraulic pressure against the headspace caused by the hot contracting sidewalls, being above Tg and therefore moveable, compresses the headspace contributing to a further rise in internal pressure inside the hot and capped container.

The combination of hydraulic pressure acting to increase the headspace pressure, and the thermo-pneumatic pressure within the headspace acting to compress the headspace causes an overall increase in the headspace pressure. This period of increased hydraulic pressure against the hot container base panel continues through to entry of the container into the cooling tunnel. All moveable base panel structures in the container may therefore be deformed longitudinally outwardly during the hot-side of the processing cycle causing base roll-out. This change in shape of the container base structures, and in any container height change, is made possible only while the container is above Tg in temperature. Importantly, the base roll out may become unrecoverable when the temperature of the base is brought back down below 75 degrees Celsius (C) or Tg in temperature. Typically the containers are filled to approximately 85 degrees C., and this causes much stress on the container base during this time, and is made worse by any light-weighting, and any addition of PCR content.

Once the container enters the cooling tunnel, both the sidewalls and the base panel are quickly brought down to under Tg, or under about 75 degrees C., and no additional significant plastic deformation will occur.

However, the plastic deformation in the moveable base, caused by any base 'roll-out' under heat stress, will only be partly recoverable and is partly nonrecoverable. The non-recoverable base panel changes and deformations encountered on the hot-side, may then be 'locked' into the container base as it enters the cooling tunnel and the plastic is brought down to below approximately 75 degrees C.

The deformed shapes of the sidewall, as well as the base, will have been 'heat distorted' to a new positions and shapes. Some of this sidewall deformation will also be partly recoverable, and some will be partly non-recoverable. The height changes and sidewall deformations, and base roll-out complications, encountered on the hot-side of processing will therefore be initially 'locked' into the container as it enters the cooling tunnel and the plastic is brought down to below approximately 75 degrees C.

Additional problems are encountered during, and after, the cooling of the container when increased amounts of PCR are incorporated into hot filled containers having a base that is moveable under vacuum pressure, and into any rigid structures incorporated into the sidewalls to resist radial expansion deformation or elongation.

Essentially, during cooling the sidewalls must regulate and control an application of vacuum force to the moveable base, or the moveable base might fail to activate properly. If the base has suffered 'roll out' or deformation under the hot side of processing, prior to entering the cooler, then the activation energy required to be regulated by the sidewalls may be increased. This becomes problematic if the sidewall structures have also deformed under the same hot side processing conditions and have in fact become weaker, not stronger. The necessary interaction between the sidewalls and the moveable base may be severely compromised.

As the hot liquid contracts during cooling, the sidewall must accommodate vacuum pressure in such a manner that vacuum pressure still builds within the container in order to activate the base. As the base moves inwardly or upwardly under the induced vacuum pressure, the sidewalls must continue to maintain structural integrity in order to maintain a sufficient and continued vacuum force to keep activation energy on the base. If the structures in the sidewall are not strong enough to maintain integrity under the vacuum induced by the cooling liquid, to then in turn cause a sufficient vacuum-induced 'base-activation vacuum force' ("BaVF") to continuously act on the base, then there may be a loss of BaVF as the sidewalls deform inwardly and fail to cause an increase in vacuum. This in turn may result in the base failing to move inwardly or upwardly properly to accommodate vacuum interactively with the sidewalls. If instead too much vacuum accommodation is taken up by undesirable deformation such as sidewall ovalization, then the ovalization accommodates the vacuum preferentially over the base panel.

More problems exist if the BaVF is not maintained and the sidewalls deform uncontrollably. In addition to ovalization of the container, there may be problematic labelling, reduced top-loads causing further problems downstream such as during palletization of container loads in distribution, and unacceptable appearance on the shelf during commercial sale, and so on.

As the PCR content increases within a container there is an increased need to control the application of BaVF in a container, where the container includes a base that is designed to be moveable under a vacuum force controlled by structures in the sidewall. With increasing amounts of PCR the base becomes more prone to 'base sag' wherein the base moves downward under the weight of the hot liquid after filling and prior to cooling. As stated above this may cause the base to change structural shape and become more resistant to moving back upward under vacuum force following cooling of the liquid contents. Thus, there is a requirement to maintain a higher BaVF than anticipated or designed into the as-molded container in the presence of amounts of PCR within the container above about 10%.

Additionally, any sidewall structures, for example horizontal annular ribbings, may become weaker with an increased PCR content above about 10%, and have less resistance to deformation under the heat stress of hot-side processing prior to cooling. This may cause a loss in strength and rigidity under vacuum build-up following cooling as the intended shapes within the sidewall are distorted and have not been able to recover intended design positions. This also causes disruption to the maintenance of a proper BaVF during cooling of the hot liquid. This can create the challenges described above during hot filling as the container is required to maintain a desired shape during the elevated filling temperatures of a hot-fill process. If crystallinity levels are suppressed or increased PCR content weakens the sidewall structures, the resulting container may not be as strong as desired or may deform at the elevated temperatures required for hot filling. As described above, increased recycled content may undesirably reduce sidewall or base stiffness or rigidity, and more importantly not retain intended design shape following heat stress and processing effects.

Accordingly, there is a need for a hot-fill container that has a high recycled content and is fully recyclable. Further, there is a need for a hot-fill container having sidewall structures with these recycle characteristics that have decreased resistance to longitudinal expansion forces in order to prevent excessive build-up of longitudinal compression forces against the base panel and can be made light weight and have good strength characteristics.

Further, there is a need for a hot-fill container to have sidewall and base configurations providing a high recycled content and being fully recyclable, and that have decreased resistance to longitudinal expansion during hot filling, and increased ability to maintain acceptable base-activation vacuum force during cooling of a liquid product following hot-filling.

There is also a need for a hot-fill container having sidewall and base structures with these recycle characteristics that provides increased protection to longitudinal compression forces against the base panel that can be made light weight and still have good strength characteristics through configuration of acceptable longitudinal expansion characteristics during hot filling.

As discussed in more detail below, this can allow for production of thinner and lighter weight bottles that maintain comparable strength to conventional bottles (e.g., 100% PET bottles) or can allow for increased base panel movement without increasing thickness or weight of the bottle.

To achieve this goal, there is a greater need to utilize ever increasing amounts of PCR in annular horizontal ribbings or similar structures configured to provide increased longitudinal expansion of containers having moveable vacuum bases, in order to prevent excessive build-up of internal pressure. The longitudinal expansion of the container reduces the pressure build up. Additionally, there is a greater need to provide base panels that are configured to move downwardly or outwardly under increased internal pressures, in order to prevent non-recoverable stretching of the base panel material, in order to retain functionality and remain within intended design parameters.

A further requirement of high-speed filling lines is related to the container surfaces at the precise time of labelling. Once the container exits the cooling tunnel it is conveyed to the labeller for application of a label. Typically this will take place before the container has reduced in temperature to ambient temperature, but will take place under a vacuum induced within the container, with the container at around 30-40 degrees C. internal temperature.

Typically, containers have vacuum deformation zones to accommodate vacuum pressure that would otherwise distort and deform the sidewalls. Typical vacuum panels are found in much prior art, and novel deformation zones are disclosed, for example, in U.S. Pat. No. 6,779,673 by the present inventor that also discloses 'inverted cage' structures surrounding a plurality of 'active surfaces'. Deformation zones that are deformed inwardly under vacuum may however appear as the container is presented for label application. The speed at which the label may be applied is limited to the available non-deformed surface area.

Accordingly, there is a need for a container having increased PCR content and minimal deformation zones that would otherwise deform radially inwardly under cooling, in order to provide for higher speed label application. However, without vacuum panels or deformation zones, increased stress from vacuum pressure is applied to the container and there is therefore a corresponding need for increased use of structures specifically aimed at imparting greater hoop strength within the container to withstand vacuum force and provide for clean surfaces to be presented to the labeller at the correct timing during processing.

There is therefore a need for a container having increased PCR in the sidewall, but increased rigidity in the sidewall. However, the increased PCR sidewall must provide increased top load characteristics and resistance to downward longitudinal force. The increased PCR sidewall must also provide acceptable resistance to longitudinal stretching forces during the hot-filling cycle.

In addition to the need for strengthening a high PCR container against both thermal and vacuum stress during filling, there is a need to allow for an initial hydraulic pressure and increased internal pressure that is placed upon a container when hot liquid is first introduced and then followed by capping. This causes stress to be placed on the container sidewall. There is a forced outward movement that would overly deform any sidewall vacuum panels, which would result in a barreling of the container.

Accordingly, there is a need for a hot-fill container that has a high recycled content and is fully recyclable. Further, there is a need for a hot-fill container and base structures with these recycle characteristics that have increased resistance to distortion during hot filling.

A further requirement of high-speed filling lines is related to ensuring finished and sealed containers exhibit good stability when palletized in high columns. A problem exists when a container design is produced on different lines e.g. neck support fillers and alternatively on base support fill lines, whereby the end bottle is a different height. Another problem exists when a container design is produced on one line that is then mixed against different container designs form other fill lines. The change in height experienced by each container design under top load pressure created in high stacking pallet loads of containers may produce varying heights in the stacked columns. This can lead to dangerous, uneven loads within the warehousing and distribution centres.

Pallet loads of stacked containers may be loaded on top of each other for periods of sustained vertical compression. Such top load causes an increase in hydraulic pressure within each container, and more importantly a reduction in height of the containers. The height and stability of such pallet column loads of containers is very important. The structural integrity of the load is paramount, and the overall height change of the column may be critical. The interactivity between the moveable base and the vertically changeable sidewalls is critical to performance of the container. Problems exist if the heights of the container vary under top load in differing amounts, especially if pallet stacked with other containers having different design constructions, or bases, or weights or amounts of PCR.

It is an object of the invention to provide an increased amount of PCR into annular horizontal ribbings or similar structures in the sidewall configured to provide increased longitudinal expansion of containers incorporating moveable vacuum bases. Increased longitudinal expansion during hot fill processing of the container relieves or prevents excessive build-up of internal pressure within the container that would otherwise be exerted against the moveable base, that would otherwise cause the base to roll outwardly and deform unacceptably. The sidewall structures are further configured to retract the longitudinal height expansion following a cooling and stacking or loading cycle in order to return closer to an as-molded or design height, and retain proper strength characteristics required by both the distribution stresses, and consumer expectations during handling.

A further object of the invention is to provide moveable base panels incorporating increased amounts of PCR that are configured to move downwardly or outwardly under increased hot internal pressures, in order to provide a higher percentage of recoverable deformation and prevent non-recoverable stretching or deformation of the base panel material, in order to provide more functionality and improved design parameters. The moveable base structures are further optimized to provide for recovery of any downward or outward deformation and move inwardly to relieve volume contraction caused by a cooling of any hot liquid filled into the container. The base structures are further optimized to accommodate hydraulic pressure build-up during vertical height pallet stacking.

A further object of the invention is to provide sidewall ribbings configured to allow increased amounts of PCR and maintain sufficient BaVF in order to interactively regulate or control the expansions and contractions required of a moveable base panel through all stages of processing and distribution.

According to another objected of the invention, the complexity contained within the proposed sidewall and base structures extends to control of the container during the overall filling cycle, and control of top load situations whereby sidewalls must withstand additional forces during distribution.

Lastly, it is also an object of the invention to overcome or ameliorate one or more of the disadvantages of the prior art or to at least provide the public with a useful choice.

SUMMARY

In a first aspect, the present disclosure broadly comprises a beverage container, comprising: a base; a cylindrical sidewall extending from and integrally formed with the base; an upper region extending from the cylindrical sidewall and defining an upper opening, wherein the beverage container comprises a longitudinal axis extending in a direction from the base to the upper opening; and a plurality of continuous channels having a first as molded channel configuration formed in and extending around a circumference of the cylindrical sidewall, wherein the continuous channels are configured to resist vacuum compression in the radial or transverse direction of the beverage container; and wherein the base includes an outer wall portion extending from the lower end of the sidewall to a plurality of discontinuous footed contact surfaces for supporting the container and a plurality of webs extending continuously from the sidewall radially along the base portion toward the longitudinal axis in the transverse direction to join a push up portion, wherein each one of the webs define a web surface that is closer to the finish than the plurality of footed contact surfaces and comprises a generally downward and continuous surface from the sidewall to the push up, further wherein the base includes inner wall portions extending alternately upward from the contact surfaces and downward from the webs; and wherein after hot filling and capping and prior to cooling the sidewall and base are configured to move interactively and in differential amounts under changing pressure conditions, wherein the sidewall is configured to expand longitudinally from a first unpressurized configuration to a second pressurized configuration, and the base portion is configured to move to a different extent longitudinally from a first unpressurized configuration to a second pressurized configuration; and wherein after cooling the sidewall is configured to contract longitudinally to a third pressurized configuration, and the base is configured to move to a different extent to a third pressurized configuration, wherein a vacuum exists within the container.

The container of the first aspect may further have any one or more of the following aspects or features defined in the following paragraphs.

In a configuration, the third pressurized configuration of the sidewall is substantially the same as the first unpressurized configuration.

In a configuration, the third pressurized configuration of the base is substantially different to the first unpressurized configuration.

In a configuration, the continuous channel is configured to move under longitudinal compression of the container and increase top load.

In a configuration, the continuous channel is configured to provide for a calculated amount of elongation in the longitudinal direction under an applied internal pressure.

In a configuration, the container comprises about 25% PCR.

In a configuration, the container comprises more than about 25% PCR.

In a configuration, the container comprises 3 continuous channels.

In a configuration, the container comprises 4 or more continuous channels.

In a configuration, at least one web comprises a compound curve angled downwardly from the sidewall to the push up.

In a configuration, the base is relatively free of additional rib elements or structure.

In a configuration, after hot filling and capping, a vacuum is created following the cooling of the liquid contents.

In a configuration, after releasing the vacuum the sidewall moves to a fourth unpressurized configuration and the base moves to a fourth unpressurized configuration.

According to another aspect, sidewall structures comprising increased PCR content to 'soften' the sidewall structures, are combined with base structures comprising increased PCR content to 'soften' the base structures. The combination of the sidewall and base panel structures are configured to reduce the negative effects of internal pressure build-up during hot filling and capping. The sidewall and base structures are configured to work interactively together to regulate the forces caused internally during the 'hot-side' of the filling cycle. The disclosed structures work interactively to reduce the internal pressure and force, and the potential for detrimental effects of these forces, applied to the sidewall and base structures in order to reduce non-returnable deformation of all container structures, and particularly to the disclosed lightweight base structures.

In a configuration, the disclosed structures can be further configured to withstand the subsequent vacuum forces created during the 'cold side' of the filling cycle within a cooling tunnel prior to additional vacuum compensations available within the moveable base structures, either by self-activation under vacuum pressure, or by forced mechanical means.

In a configuration, the disclosed sidewall and moveable base structures can therefore provide increased control of the lightweight container during the overall filling cycle, and control of top load performance following the filling and processing cycle, whereby containers must withstand additional forces during distribution. In a configuration, the disclosed sidewall and base structures can be configured to be made lightweight, with increased amounts of PCR, to both withstand and regulate interactively the opposite forces of both compression and expansion during the hot-side filling cycle, in addition to the vacuum forces created during the cold-side of the filling cycle within the cooling tunnel.

As discussed in more detail below, some configurations can allow for production of thinner and lighter weight bottles that maintain the same strength as conventional bottles, yet contain more than 20-25% PCR.

Further variations encompassed within the systems and methods are described in the detailed description of the invention below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Throughout the drawings, reference numbers can be reused to indicate general correspondence between reference elements. The drawings are provided to illustrate example embodiments described herein and are not intended to limit the scope of the disclosure.

DETAILED DESCRIPTION

Figure 1A:
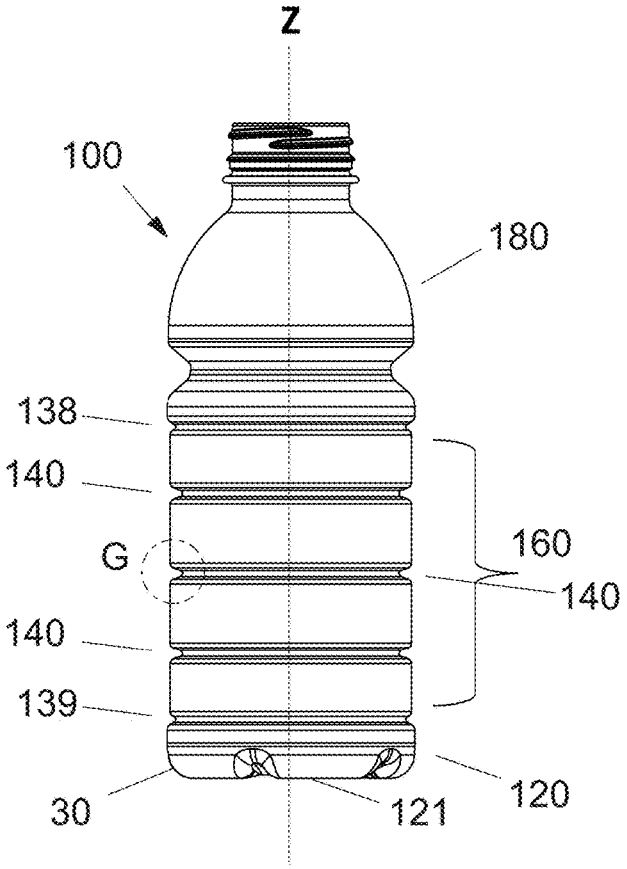
FIG. 1A is a side view of a beverage container constructed and operative in accordance with an embodiment of the invention.

Although certain examples are described below, those of skill in the art will appreciate that the disclosure extends beyond the specifically disclosed examples and/or uses and obvious modifications and equivalents thereof. Thus, it is intended that the scope of the disclosure herein disclosed should not be limited by any particular examples described below.

During blow-molding, heat may be added to the bottle wall, which can increase crystallinity of the polymer composition. In some embodiments, during blowmolding heat is added until the crystallinity is at least 30% at any given point on the container. After blow-molding, the container may be filled. In some embodiments the container is filled using a hot-fill process, however the configurations disclosed impart greater strength to the container that benefits cold filled or aseptic process filling also. In some embodiments, the container is filled with a beverage at a temperature from 70 degrees C. to 100 degrees C. (e.g., from 85 degrees C. to 95 degrees C.), After filling, the container may be capped and the contents cooled.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

Beverage containers according to the present invention are suitable for storing various types of beverages and may be composed of a plastic material, such as polyethylene terephthalate (PET), among others. Such plastic beverage containers may in some embodiments have a generally cylindrical construction. The plastic beverage containers may be filled with a beverage via a hot-filling operation. In a hot-filling operation, a beverage to be stored in the beverage container is heated to an elevated temperature, such as a temperature of about 170 degrees Fahrenheit (F) or more, and deposited in the beverage container. The beverage container may be supported on a support surface during filling, or the beverage container may be suspended by an upper end, or neck, of the beverage container during filling. Once filled and capped, the beverage container and beverage therein are rapidly cooled. This cooling of the beverage may result in thermal contraction, which reduces the internal volume of the beverage container. To accommodate the resulting pressure differential, side walls of the beverage container of the present invention may be strengthened against being pulled inward.

To help the beverage container maintain its cylindrical shape throughout the process of filling the beverage container with a liquid and subsequently during storage and transportation of the beverage container, one or more generally horizontal ribs may be formed in the beverage container, and preferably vertically displaced through all sections of the container requiring strengthening. The ribs may be formed on the beverage container as recessed (indented) channels that extend toward an interior volume of the beverage container and extend completely around the circumference of the beverage container in a plane transverse to a longitudinal axis of the beverage container. The ribs help to prevent the beverage container from paneling or otherwise deforming when an internal pressure of the beverage container is less than an external pressure. While the ribs extending around a circumference of the beverage container may help to avoid paneling, the ribs of the present invention are further configured to include an increased amount of PCR, preferably over 20% recycled content mixed with virgin polyethylene terephthalate or PET and are configured to provide the beverage container with capacity for elongation in a longitudinal direction during certain types of filling operations.

As the beverage container of the present invention is composed of plastic, the plastic container is configured to avoid deformation of the base portion when heated to a sufficiently high temperature, such as a temperature at or above the glass transition temperature of the beverage container. As a result, when the beverage container is capped or sealed after being filled with a high temperature beverage, and following the heat induced increase in pressure build up that acts against the sidewalls and base, the sidewall and base of the present invention are configured to move outwardly in a longitudinal direction during the period of intense heat being applied to the container surfaces, in order to reduce pressure and stress upon the surfaces.

Elongation of the beverage container sidewall is desirable during the initial period of pasteurization on the 'hot side' of the processing cycle following hot filling and capping of the beverage container in order to reduce stress that would otherwise be directed upon the base, and as disclosed in the present invention, the base is further configured to move outwardly in a longitudinal direction interactively with the sidewalls to even further reduce the stress upon the base structures to avoid deformation.

According to one embodiment of the present invention, and with reference to FIGS. 1A to 1F, an example beverage container 100 includes a base 120, a sidewall 160 extending from and integrally formed with base 120, and an upper region 180 extending from and integrally formed with sidewall 160 and defining an upper opening. Beverage container 100 includes a longitudinal axis Z extending centrally in a direction from base 120 to upper region 180. Sidewall 160 is generally cylindrical such that beverage container 100 has a generally circular transverse cross section (not accounting for channels formed in sidewall 160).

One or more horizontal channels 140 are formed in sidewall 160 that serve to prevent or limit radial deformation of beverage container 100 in a direction perpendicular to the longitudinal axis Z. Channels 140 are formed as recessed areas in sidewall 160 that extend toward an interior volume of beverage container 100. Channels 140 serve to resist paneling of sidewall 160 (e.g., when an internal pressure of beverage container 100 is less than an external pressure) by contributing hoop strength to beverage container 100. Additional horizontal channels 138 and 139 are placed above and below horizontal channels 140.

Specifically in the present invention, the channels of beverage container 100 are additionally configured to provide a certain amount of elongation in a direction of longitudinal axis Z when beverage container 100 is filled with a beverage having a temperature at or above a glass transition temperature of the material forming beverage container 100 (e.g., PET).

Figure 1B:
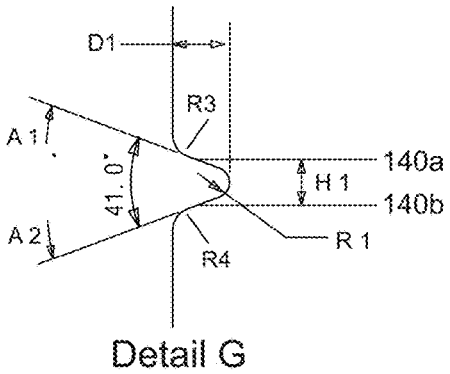
FIG. 1B is an enlarged view of a horizontal channel of the beverage container of FIG. 1A.
Figure 1C:
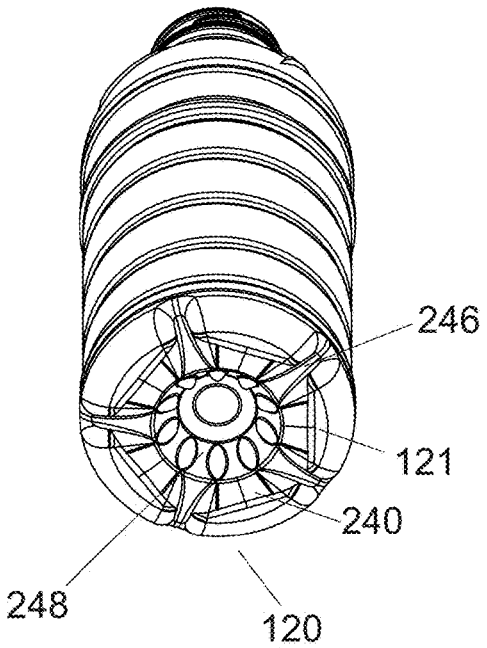
FIG. 1C is an isometric view of the beverage container of FIG. 1A.
Figure 1D:
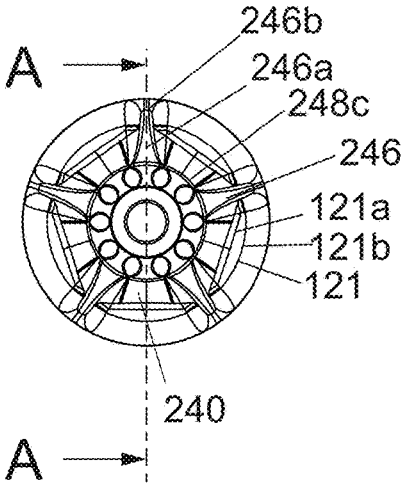
FIG. 1D is a bottom view of the beverage container of FIG. 1A.
Figure 1E:
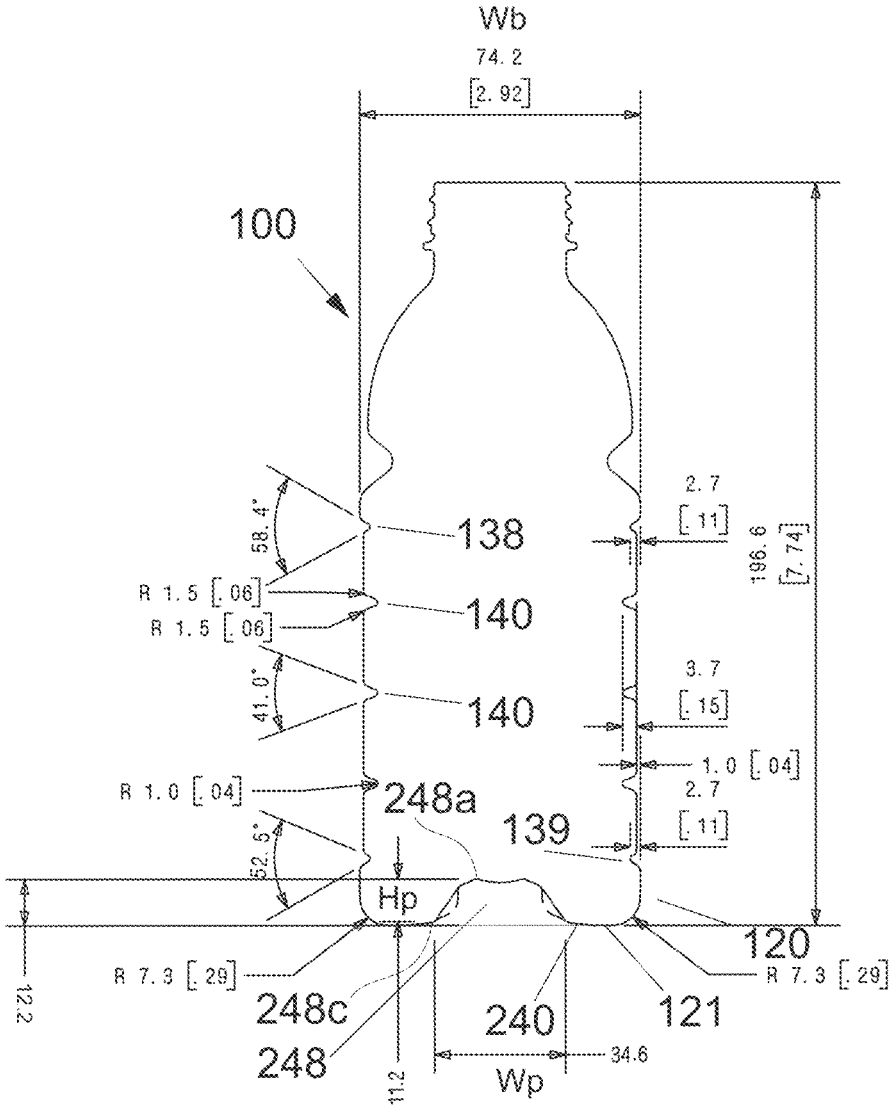
FIG. 1E is a cross-sectional view of the beverage container of FIG. 1A.

With reference to FIG. 1B, the amount of elongation in the longitudinal direction is governed by the configuration of the channels 140, 138 and 139, and the amount of PCR content each channel comprises. In container 100 the horizontal channels 140 may have a certain depth inward into the body portion (D1), a central inner annular radius (R1) defining the inner portion of the channel, a certain height of the channel (H1)—measured in the present embodiment between the midpoints of the upper portion 140*a* and lower portion 140*b* of the channel, wherein the upper portion 140*a* forms an angle joining the central inner annular radius R1 to the sidewall portion above the channel (A1) that could be for example about 20.5 degrees, and the lower portion 140*b* forms an angle joining the central inner annular radius R1 to the sidewall portion below the channel (A2) that could also for example be about 20.5 degrees, such that the overall angle between the upper and lower portions is about 41 degrees in the as-molded container.

In the present embodiment the elongation is further controlled by the presence of an upper radius R3 joining the upper part of the channel to the sidewall and a lower radius R4 joining the lower part of the channel to the sidewall. It will be appreciated that many other angular combinations, and structures within the channels are intended to be utilized, depending especially on the particular amount of PCR present in the container, and what final top load characteristics are required in the final distributed and sealed container, thus requiring careful consideration of the relevant 'levers' available to control elongation.

According to the exemplary embodiment shown in FIGS. 1A to 1F, the lower portion of the container 100 has a bottle width Wb and includes a concave outer wall portion 30 that extends from the lower end of the sidewall 160 to a contact surface outer border 121*b* of a plurality of discontinuous footed contact surfaces 121 for supporting the container.

A plurality of webs 246 extend continuously from the sidewall radially along the base portion toward the longitudinal axis in the transverse direction to join the base of the push up base 248*c* on the outside border of the push up 248 opposite the top of the push up 248*a*. Each one of the webs define a web surface that is closer to the finish than the plurality of footed contact surfaces 121 and may comprise a compound curve that is generally downward and continuous from the sidewall to the push up 248. In other embodiments the web surface may be substantially linear.

An inner wall extends generally circumferentially from within the contact surfaces 121 to the push up base 248*c*. The contact surface inner border 121*a*may define part of the outside boundary of the inner wall.

The inner wall portion defines a large part of the moveable base, comprising distinct regions having different angular configurations. An inner wall portion 240 extends upwardly from the contact surface 121 to the push up portion 248. The push up portion 248 has a push up height Hp measured between the base of the push up 248*c* and the top of the push up 248*a*, and a width Wp measured at the base of the push up 248*c*. The inner wall portions 246*a* of the web comprise inner wall portions extending downwardly from the outer portions 246*b* of the webs. The inner wall therefore comprises portions that are both upwardly and downwardly angled. The downwardly angled compound curves of the webs 246, and the upwardly angled inner wall portions 240, are preferably relatively free of all other geometry such as strengthening ribs, and comprise preferentially more than about 20-25% PCR. This configuration provides both an affinity for a controlled outward movement and an affinity for a controlled upward or inward movement, without being constrained by additional rib structures. The base 120 is provided with sufficient strength to allow returnable expansion from an outward or downward position to an inward or upward position by the alternating upwardly angled inner wall portions 240 and downwardly angled inner wall portions 246*a*. These alternating upward and downward angled portions are maintained in alternating array relative to the general plane of the inner wall as the base moves from upward to downward positions, and also downward to upward positions, removing excess stress from the base structures as movement occurs.

Figure 2:
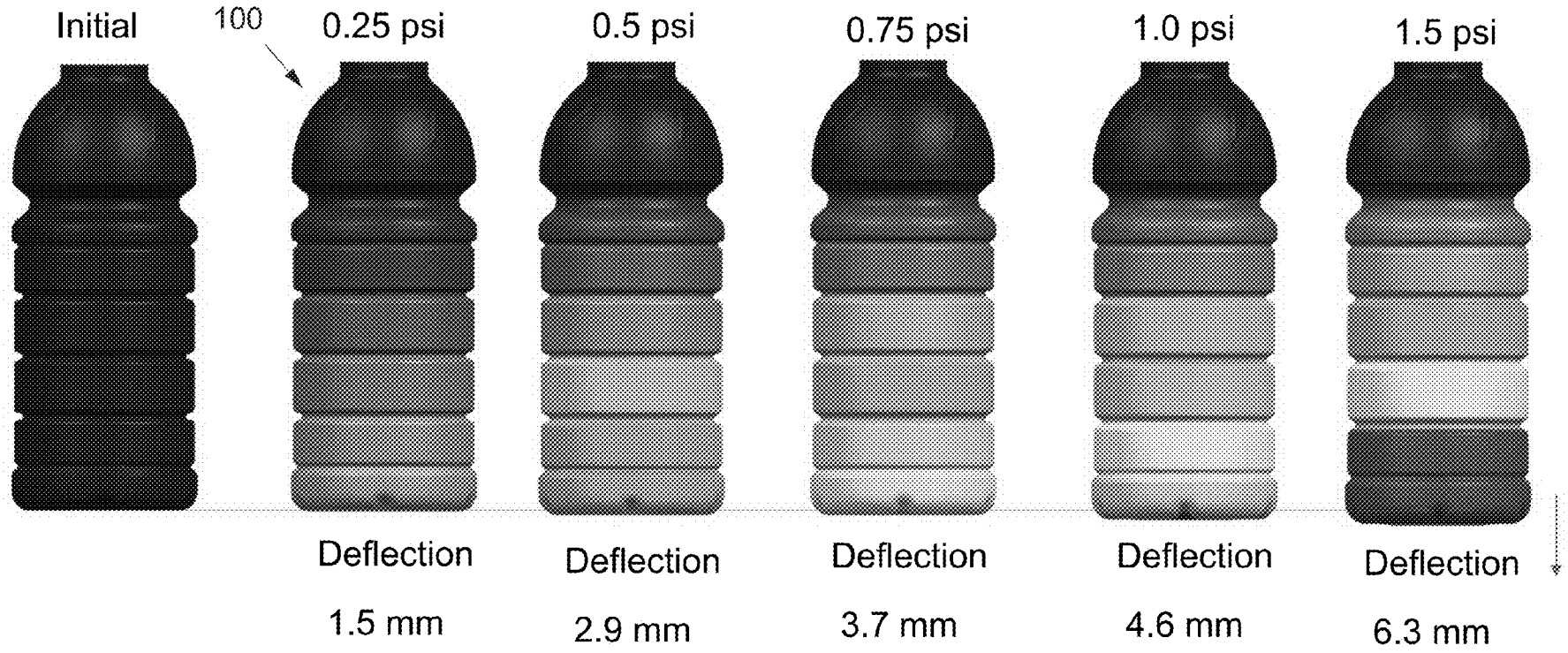
FIG. 2 illustrates the overall longitudinal effect of increasing pressure within the beverage container of FIG. 1A after hot filling and capping.
Figure 3A:
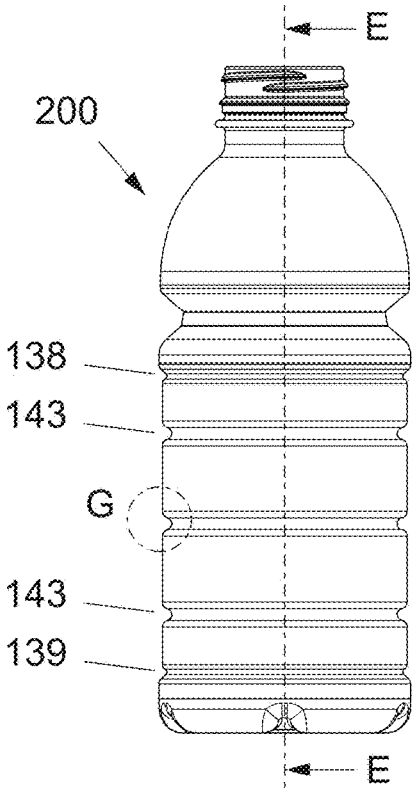
FIG. 3A is a side view of a beverage container constructed and operative in accordance with another embodiment of the invention.
Figure 3B:
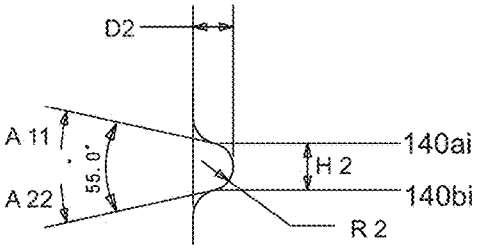
FIG. 3B is an enlarged view of a horizontal channel of the beverage container of FIG. 3A.
Figure 3C:
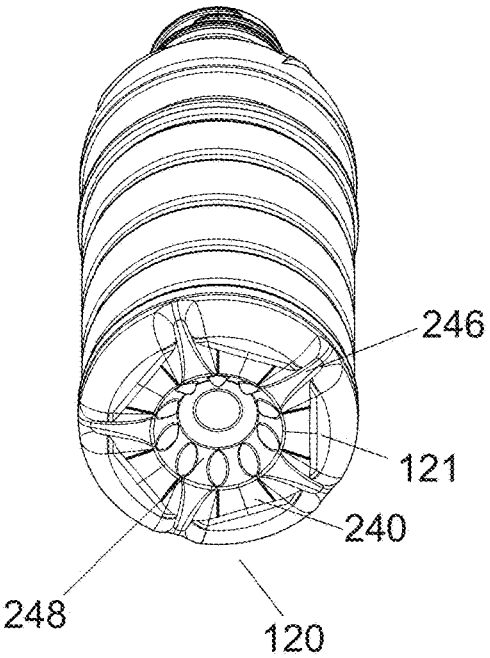
FIG. 3C is an isometric view of the beverage container of FIG. 3A.
Figure 3D:
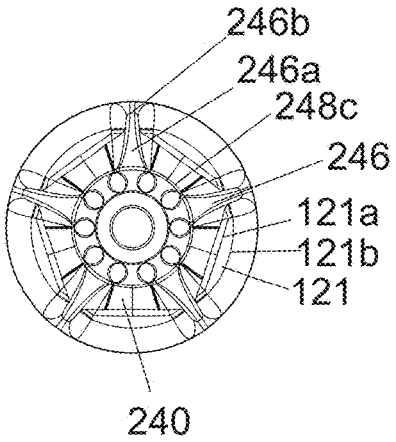
FIG. 3D is a bottom view of the beverage container of FIG. 3A.
Figure 3E:
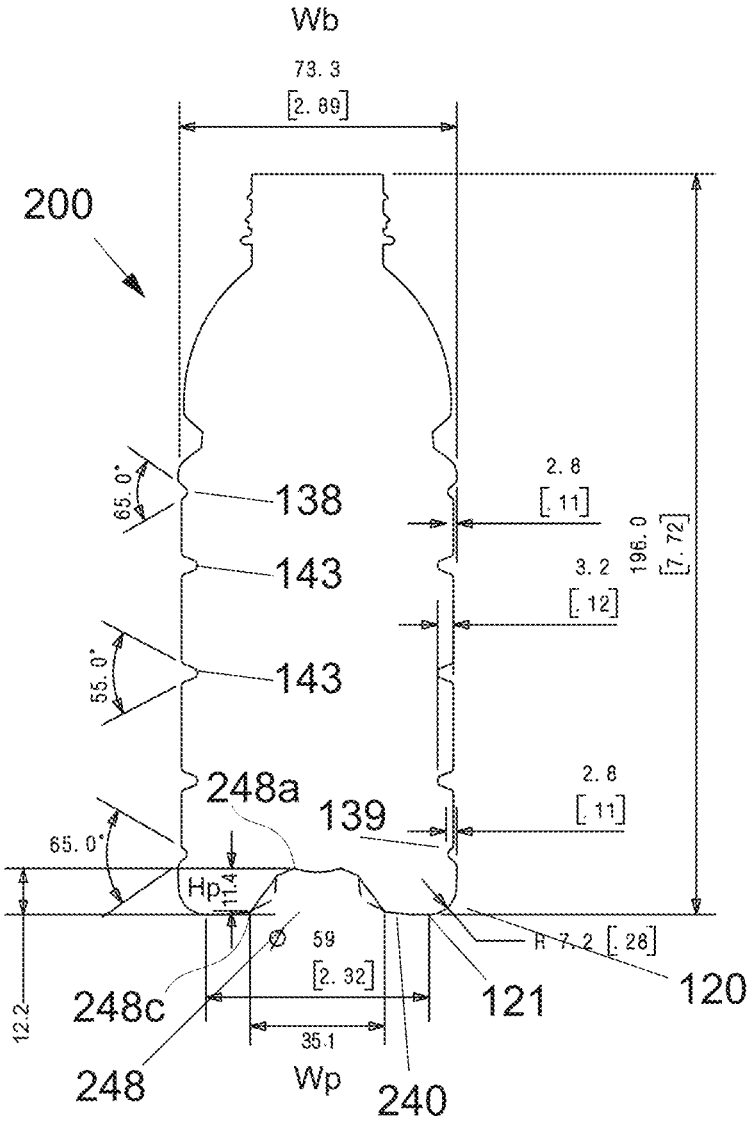
FIG. 3E is a cross-sectional view of the beverage container of FIG. 3A.

With reference to FIG. 2, container 100 is subjected to varying amounts of stress under Finite Element Analysis to show the overall longitudinal effect of increasing pressure within the container following capping after hot filling the container, while the container is being conveyed through a typical fill system and prior to entering the cooling tunnel. As the effective pressure increases the bottle increases in overall height in the longitudinal direction, the height gain being created by both an elongation of the sidewalls and a movement outward of the base. Also, elongation of the sidewalls provides for a reduction in internal pressure and a reduction in the forces directed at the base portion.

Any increase in the amount of resistance to elongation in the longitudinal direction results in an increase in the amount of force applied directly to the base structures, causing base roll out to increase and increasing the potential for permanent deformation of the base. Any decrease in the amount of resistance to elongation in the longitudinal direction causes a corresponding decrease in the amount of force applied directly to the base structures.

With reference to FIGS. 3A to 3E and container 200, the amount of resistance to elongation in the longitudinal direction is increased relative to the container 100 in FIG. 2 by the changed configuration of the channels 143. In container

200 the horizontal channels 143 have a lesser depth inward into the body portion (D2), and a larger inner annular radius (R2) defining the inner portion of the channel. Additional configurations to increase resistance to elongation may include increasing the height of the channel (H2) by increasing the angles of the upper portion 140*ai* joining the inner annular radius R2 to the sidewall portion above the channel (A11) and an angle of the lower portion 140*bi* joining the inner annular radius R2 to the sidewall portion below the channel (A22).

Figure 4:
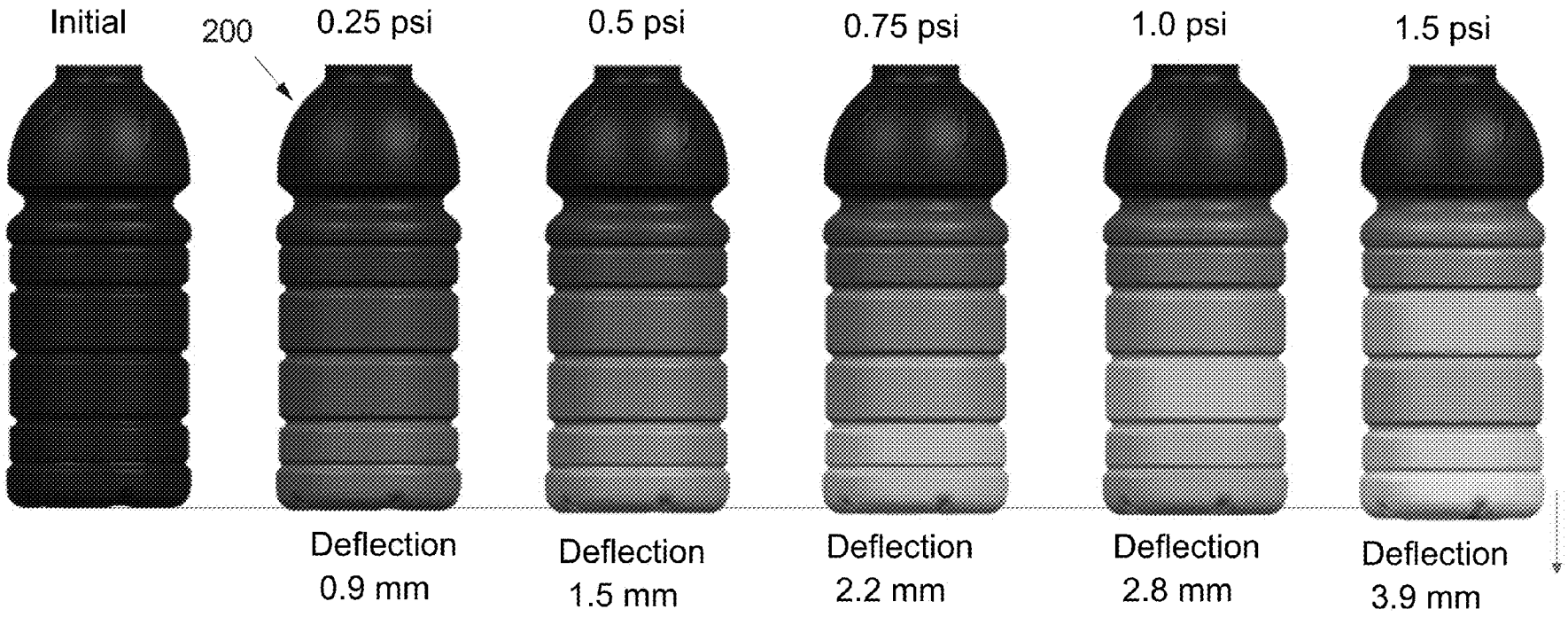
FIG. 4 illustrates the overall longitudinal effect of increasing pressure within the beverage container of FIG. 3A after hot filling and capping.

With reference to FIG. 4, container 200 is subjected to the same varying amounts of stress under Finite Element Analysis to show the effect of overpressure after filling and capping the container 200 while the container is being conveyed through the filling system and prior to entering the cooling tunnel. As the effective pressure increases Bottle 200 increases in overall height in the longitudinal direction, but increases in overall height to a lesser amount than container 100, resulting in an increase in relative force being applied to the base structures.

In addition, the amount of elongation in the longitudinal direction of Bottle 100 is increased when compared to Bottle 200 due to the configuration in the respective channels. This increased configuration to expand longitudinally provides the sidewall in Bottle 100 with a subsequent decrease in internal pressure during the critical hot fill phase when both bottles are filled with the same liquid at the same temperature and processed in the same manner. Both Bottle 100 and Bottle 200 include the same moveable base configuration, but the sidewall of Bottle 100 is able to reduce the amount of pressure and stress applied to the moveable base of Bottle 100 during the critical hot side of the filling process.

During this critical heated phase, the moveable base of Bottle 100 is configured to move outwardly under the reduced stress inside the container, in order to further prevent overstress being applied to the structures within the base.

Figure 1F:
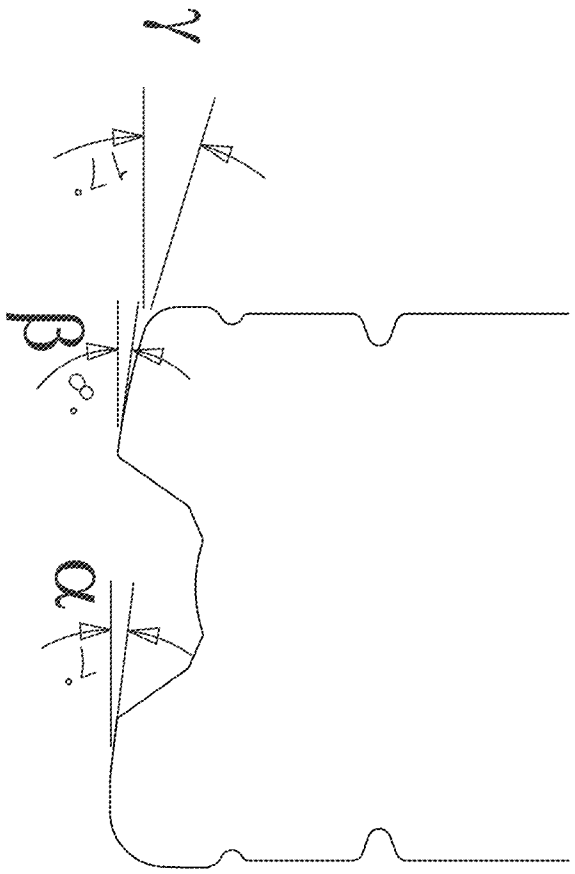
FIG. 1F is an enlarged cross-sectional view of the lower portion and base of the beverage container of FIG. 1A.

With reference to FIG. 1F, a cross section view of the moveable base of Container 100 through plane A-A shows the upwardly angled inner wall 240 (by way of example only, upwardly angled alpha at about 7 degrees) and the downwardly angled beta web portion 246*a* (by way of example only downwardly angled at about 8 degrees) with the entire web being continuous from the sidewall 160 to the push up 248, and comprising a downward compound curve including portions ranging downward between about 17 degrees to 8 degrees respectively, including the web portion 246*b* gamma and the downwardly angled inner wall portion 246*a* beta to join the base of the push up base 248*c*. Additionally, the cross section view also shows the upwardly angled inner wall portion 240 joining the contact surface 121 to the base of the push up base 248*c*. It will be appreciated that the improved base of the present invention may be included in both Container 100 and Container 200 and provide for both outward and inward movement for both Containers, despite the differing amounts of internal heat stress and pressure created in the respective Containers as a result of the varying channel structures.

In addition to increases in heat stress pressure on the base, with ribs or channels configured to prevent sidewall elongation, a further problem may exist with such reductions in depth of horizontal annular grooves during hot fill processing. As the grooves are configured to reduce elongation, for example by reducing the depth D of the groove, the hoop strength of the grooves, channels or annular ribs may also reduce. As the hot liquid is cooled within a sealed container and a vacuum pressure force increase within the container, the container with the decreased elongation characteristics may experience problems maintaining shape and begin deforming or ovalizing while in distribution or in the consumer hands.

Figure 5:
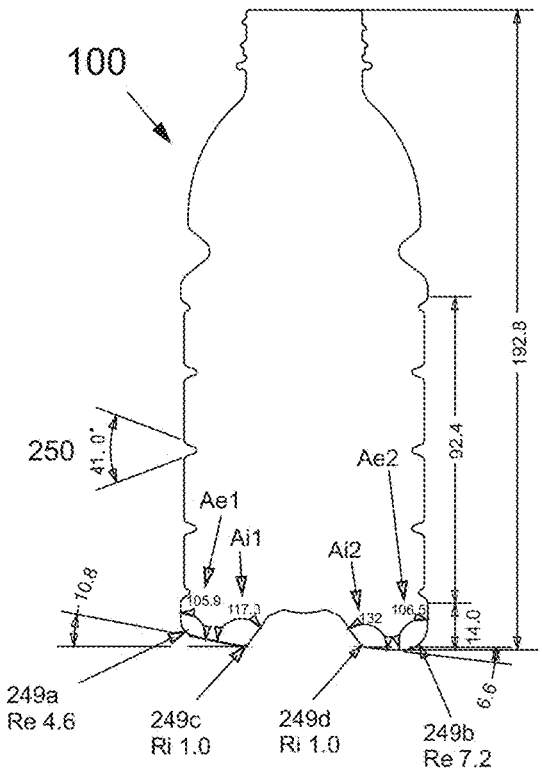
FIG. 5 is a cross-sectional view of the beverage container of FIGS. 1A-1F as molded constructed and operative in accordance with an embodiment of the invention.
Figure 6:
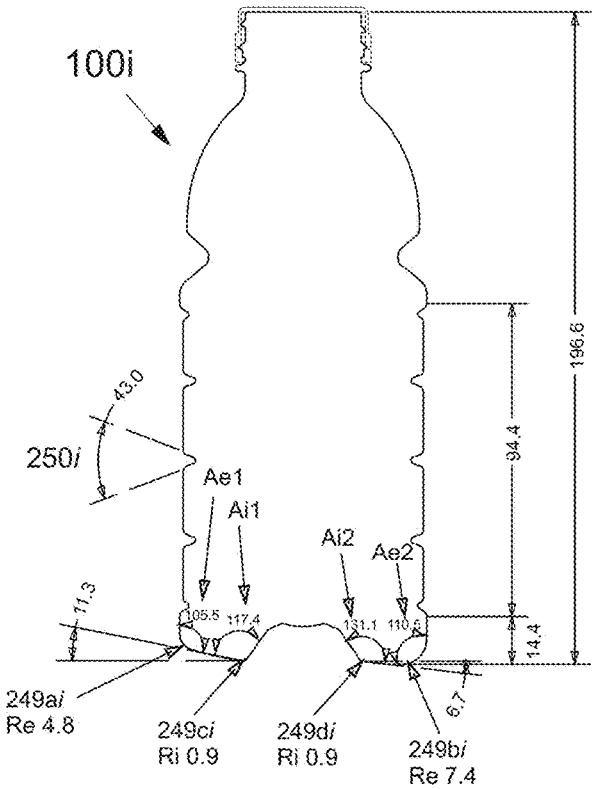
FIG. 6 is a cross-sectional view of the beverage container of FIG. 5 after hot filling, capping, and prior to cooling.
Figure 7:
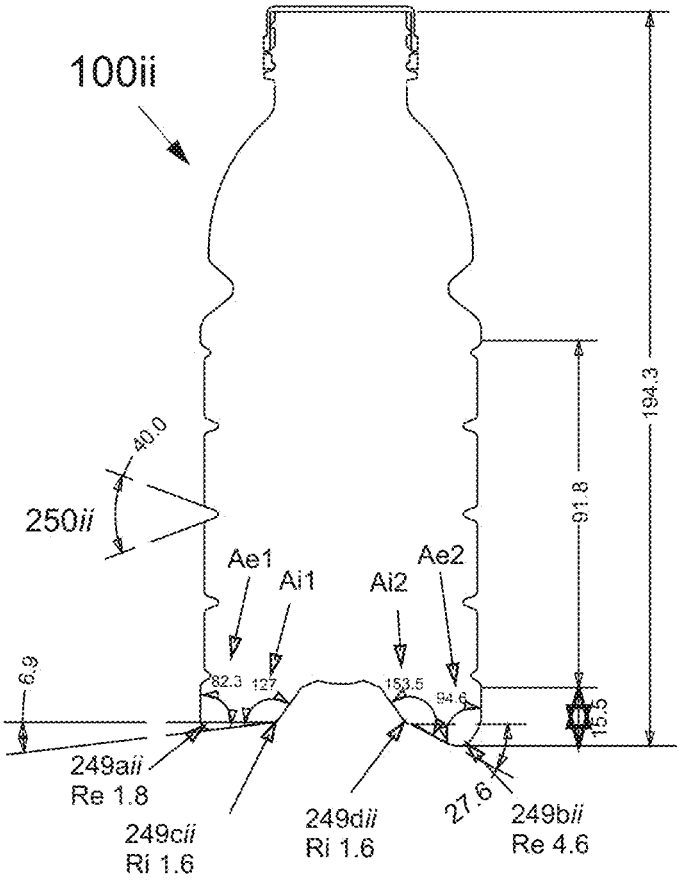
FIG. 7 is a cross-sectional view of the beverage container of FIGS. 5-6 post cooling.

With reference to FIGS. 5 to 7, the as-molded Bottle 100 of FIG. 5 increases in longitudinal length after being hot filled and capped as shown in FIG. 6. The bottle is then conveyed toward a cooler but held at a heated temperature first for a period of approximately at least one minute. During this time of increased pressure within the container the sidewall of Bottle 100*i* increases in length through a change in radius or height within each of the horizontal channels, as illustrated with reference to channel 250 and 250*i*. As illustrated, Bottle 100 is about 20 fluid oz in volume and as configured according to the present invention may expand around 2 mm in height in the label panel application area comprising the ribbings or channels and 0.4 mm in height in the base structures. The channels in this example may provide 80% of the overall longitudinal expansion while the base is protected from severe overpressure therefore.

Interactively, the moveable base is configured to move outwardly in order to also protect against heat stress induced deformation, but is configured to move and contribute only about 20% of the height increase in the lower ⅔ of the container, which is a manageable amount without leading to base-roll out and vertical stability issues, or leading to thermal distortion and subsequent failure to operate under the vacuum cycle. Without the addition of channel structures in the sidewall configured to expand longitudinally, the pressure within the container would be higher and this would lead to a greater force being applied to the heated base, causing severe base roll-out and permanent deformation of the base structures.

The base can be configured to include 4 different controlling radii, and 4 different controlling major angles surrounding the controlling radii by the adjoining major structure. With respect to the controlling radii and controlling major angles, a pair of radii reduce in radius while an alternate pair increase in radius, with each pair comprising different controlling angles and all 4 radii and controlling angles operating to differing degrees. By way of example only, as shown in the drawings a "first external radius Re" 249*a* may increase in radius from about 4.6 mm to about 4.8 mm at 249*ai* around the junction of the web with the lower sidewall. The major controlling angle Ae1 surrounding 249*a* however, may in fact decrease at the same time. In other embodiments the major controlling angle may be configured to also increase and exert a lesser influence on controlling push up downward movement. Correspondingly a "first internal radius Ri" 249*c* may decrease in radius from about 1 mm to about 0.9 mm at 249*ci* around the junction between the internal portion of the web and the push up and the corresponding controlling major angle Ai1 may increase as control in exerted over the base of the push up to prevent downward movement.

Additionally, a second internal radius RiΔ 249*d* that is not comprising web structure may decrease in radius from about 1 mm at 249*d* to about 0.9 mm at 249*di* around the junction formed between the upwardly angled inner wall portion 240 joining the contact surface 121 to the base of the push up base 248*c*, and the corresponding controlling major angle also decreases. Further, even if the second internal radius is configured to be the same as the first internal radius, it should be appreciated that the controlling major angle for each that is formed around the respective push-up base geometry sections may be substantially different insofar as angles surrounding each radius may be different to each other, and the direction of angular movement as the base moves downward may be different, and for example may be in the opposite directions with controlling major angle Ai1 provided around 249*c* becoming larger and the controlling major angle Ai2 around 249*d* becoming smaller.

As can be seen therefore, the sidewall may be configured to move from a first unpressurized configuration as molded in FIG. 5, for example comprising an angle of each channel about 41 degrees between the upper and lower portions of a rib or channel, as illustrated at channel 250, to a second pressurized configuration after hotfilling and capping, wherein the second configuration is longitudinally greater in height than the first as the rib or channel moves to a greater angle than 41 degrees—for example becoming about 43 degrees indicated at 250*ii*. It is anticipated that certain embodiments may have different angular orientations, and that a number of different channel angles may be present in a container having different size channels selected to cooperate together. Additionally, the moveable base is configured to move interactively with the expanding sidewall from a first unpressurized, as molded configuration in FIG. 5 to a second pressurized configuration in FIG. 6. In the second pressurized configuration, the "first external radius Re" 249*a* of the web may be configured to increase in radius, while the first and second internal radii of the base 249*c* and 249*d* may be configured to both decrease in radius, but their respective major controlling angles Ai1 and Ai2 may move in alternating directions. The web structure overall moves outwardly and downwardly increasing in downward angle while restraining excessive movement of the base of the push up downwardly.

Additionally, there exists a "second external radius Re" 249*b* on the footed portion of the base, and this external radius is also preferably configured to increase in amount of radius to control and provide for the base to move outwardly to further reduce stress and pressure from within, by way of example as illustrated the increase in the second external radius may be from about 7.2 mm at 249*b* to about 7.4 mm at 249*bi* around the junction formed between the contact surface with the lower sidewall. The major controlling angle Ae2 surrounding the second external radius may be configured to also increase alongside the increase in radius. This increased ability to reduce pressure is driven by the interaction of both the sidewalls and base expanding longitudinally in a controlled manner, preferably comprising a calculated percentage of PCR and corresponding structure to control any softening or weakening effect of the at least 20% PCR, to extend the bottle longitudinally along both the sidewalls and base interactively. This reduction in stress avoids permanent deformation occurring in the container structures, in order to prepare the base and sidewalls of the container for the subsequent stresses to be further accommodated following cooling.

With reference to FIG. 7, following entry to the Cooling Tunnel the configurations of the sidewall and base provide for a substantial return of the sidewall towards the as-molded configuration during the typical timeframe required in distribution channels, of at least 6 months. During this time, and prior to opening, the sidewall is configured to move progressively to a third pressurized configuration, wherein the third configuration is longitudinally less than the second configuration, and preferably approximately similar to the first as molded configuration, or alternatively shorter than the first as molded configuration. By way of example only, Bottle 100*ii* is shown to have a moveable base held in a third pressurized configuration, interactively with the third pressurized configuration of the sidewall. The first external radius 249*aii* of the web portion of the base may be configured to decrease substantially from the second configuration to the third configuration, and additionally the structures and major controlling angle Ae1 surrounding 249*a* are configured to change from an obtuse angle at 249*ai* toward an acute angle at 249*aii*. The first internal radius 249*ci* may be configured to increase from the second configuration to 249*cii* in the third configuration. Additionally, the surrounding structures and major controlling angle of 249*ci* may move from an obtuse angle toward a more obtuse angle at 249*cii*. The second internal radius 249*di* may be configured to increase in radius from the second configuration to 249*dii* in the third configuration, and the surrounding structures and major controlling angle Ai2 may be additionally configured to also increase from an obtuse angle to a more obtuse configuration. The second external radius 249*bi* may be configured to decrease in radius from the second configuration to 249*bii* in the third configuration, and the surrounding structures and major controlling angle Ae2 may also move toward a more acute angle configuration. The ability of the base to avoid deformation during the hot fill side of processing, by moving outwardly in a particularly configured manner, controlled by a pair of external radii 249*a* and 249*b* and a pair of internal radii 249*c* and 249*d*, wherein each pair may controlled in different ways by different major controlling angles and different radii such that the base may move outwardly in a controlled manner to decrease pressure in the container, in conjunction with the elongation of the sidewalls, permits the base to retain 'as-molded' design capability in order to subsequently move efficiently during a vacuum increase following a cooling of the hot liquid without receiving too much stress that would otherwise cause base roll-out and permanent deformation, particularly in the presence of a percentage of PCR exceeding about 10%.

Figure 8:
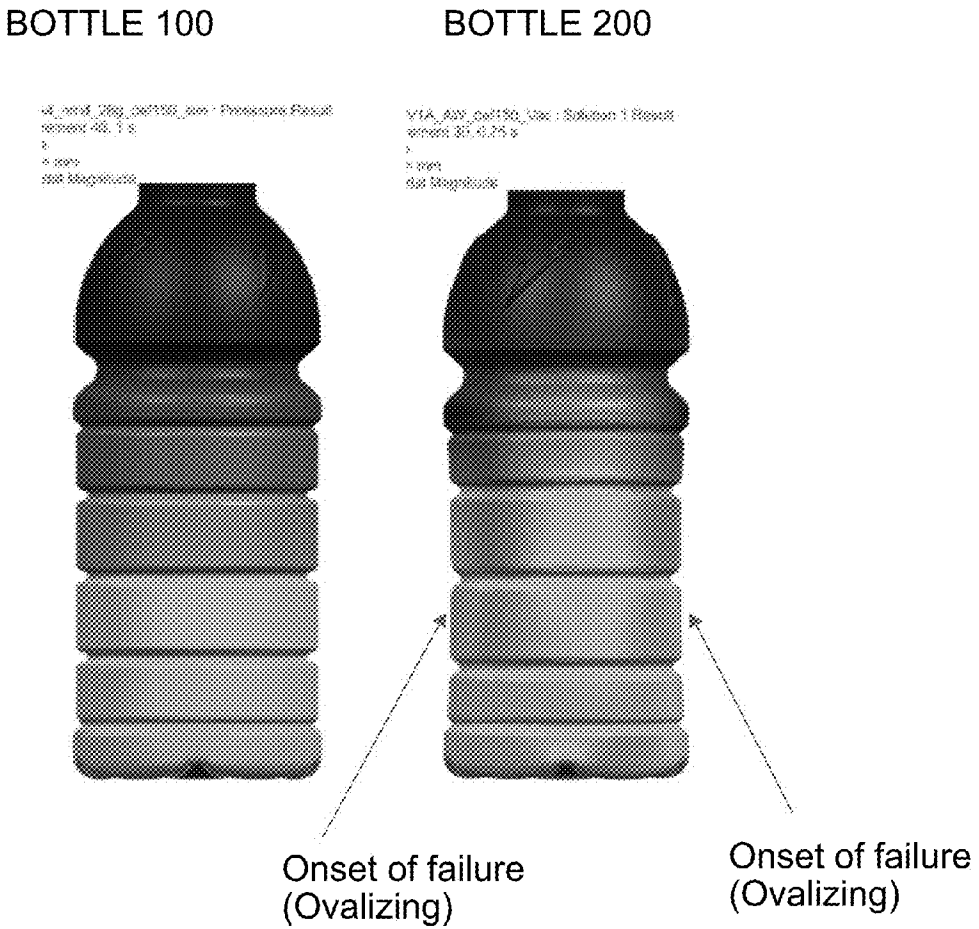
FIG. 8 Illustrates the overall vacuum effect of decreasing pressure within the beverage containers of FIGS. 1A-1F and FIGS. 3A-3E after hot filling and capping and cooling.

As shown in FIG. 8, the sidewall of Bottle 100 is designed to provide the required hoop strength and resistance against ovalization under hot fill vacuum conditions. The ribs are configured with sufficient depth or strength, as opposed to the depth and strength of the ribs of Bottle 200, which ovalizes under vacuum pressure earlier than Bottle 100. The configuration provided for in Bottle 100 further provides good elongation under hot fill to remove internal pressure stress from the base. The moveable base is configured to move to several positions, including outwardly to remove as much internal stress as possible during hot fill, and then inwardly to remove vacuum.

Figure 9A:
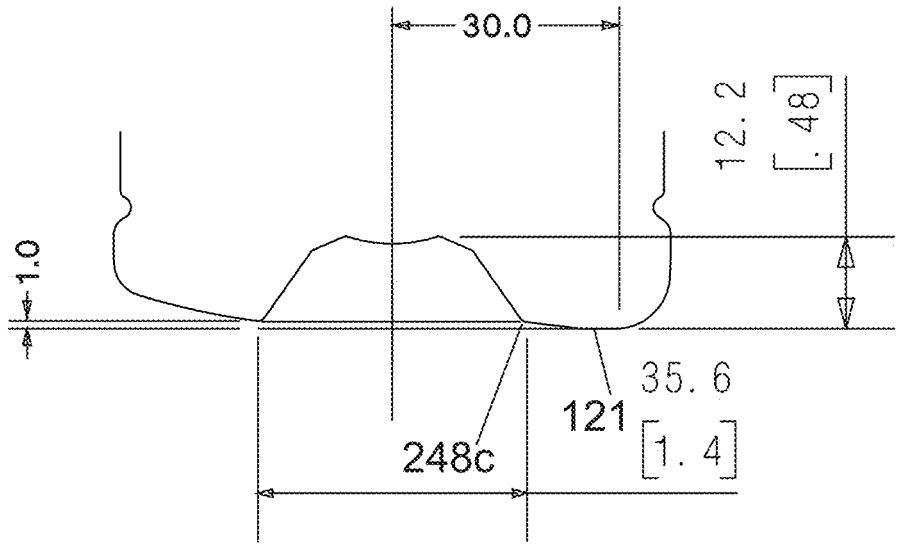
FIG. 9A is a cross-sectional view of a base of a beverage container constructed and operative in accordance with an embodiment of the invention.
Figure 9B:
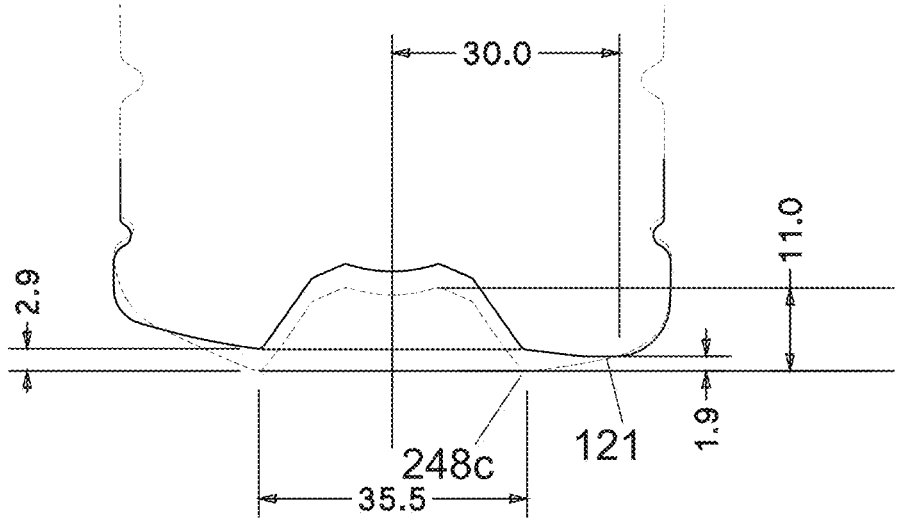
FIG. 9B is a cross-sectional view of the base of FIG. 9A rolling out under internal heated pressure.

With reference to FIGS. 9A and 9B, another preferred embodiment of the present invention discloses further improvements in performance. FIG. 9B illustrates the potential for the base of the container of FIG. 9A to roll out under internal heated pressure, for example if the ribs or channels are not configured to provide enough vertical compensation and a high percentage of PCR is included in the container. As shown in FIG. 9A the base 248*c* of the push up is placed a small distance above the contact surface 121, for example approximately 1 mm. Under severe heat pressure following capping of the container, the base may receive too much pressure and be forced to move outwardly too far, as shown in FIG. 9B, and below the contact surface 121. Such could occur in the event the base is weakened by a high percentage of PCR, and the ribs or channels of the sidewall are also weakened by a high percentage of PCR and not configured properly to expand longitudinally enough to prevent pressure build-up causing such base roll out, and if the particular filling methodology is particularly aggressive—for example neck support filling with applied overpressure. In such an instance, particularly if the channels are not designed to expand longitudinally as embodied in the present invention, the hot-filled bottle may become unstable during the time required to convey the sealed container standing on its base prior to entering a cooling tunnel, whereupon the base is required to retract upwardly to accommodate liquid contraction and vacuum build-up.

Figure 9C:
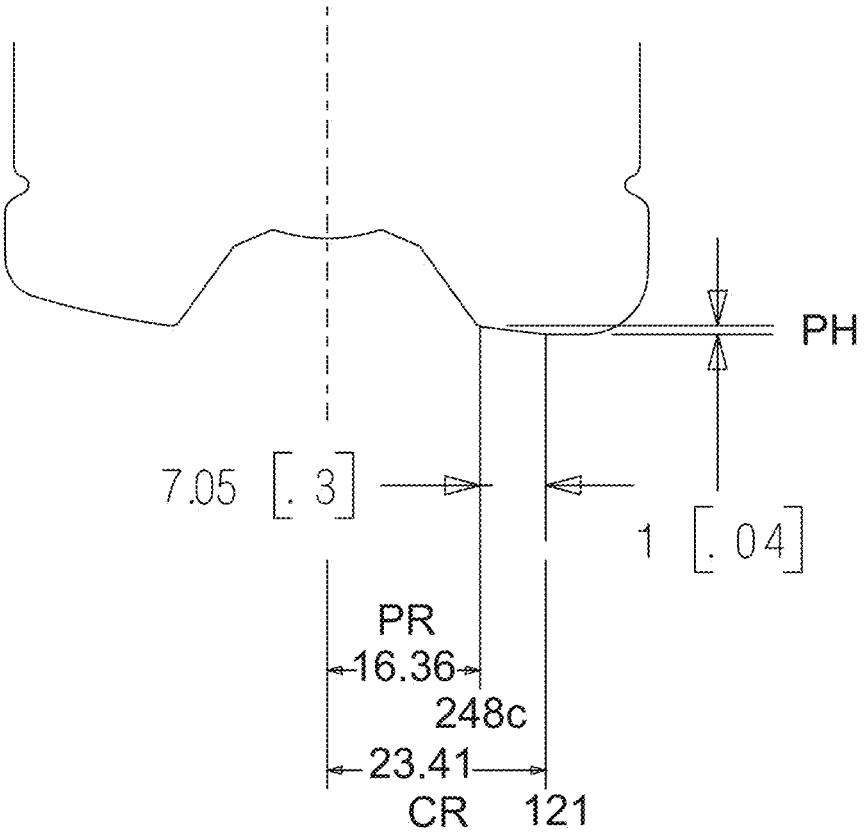
FIG. 9C is a cross-sectional view of a base of a beverage container constructed and operative in accordance with an embodiment of the invention.
Figure 9D:
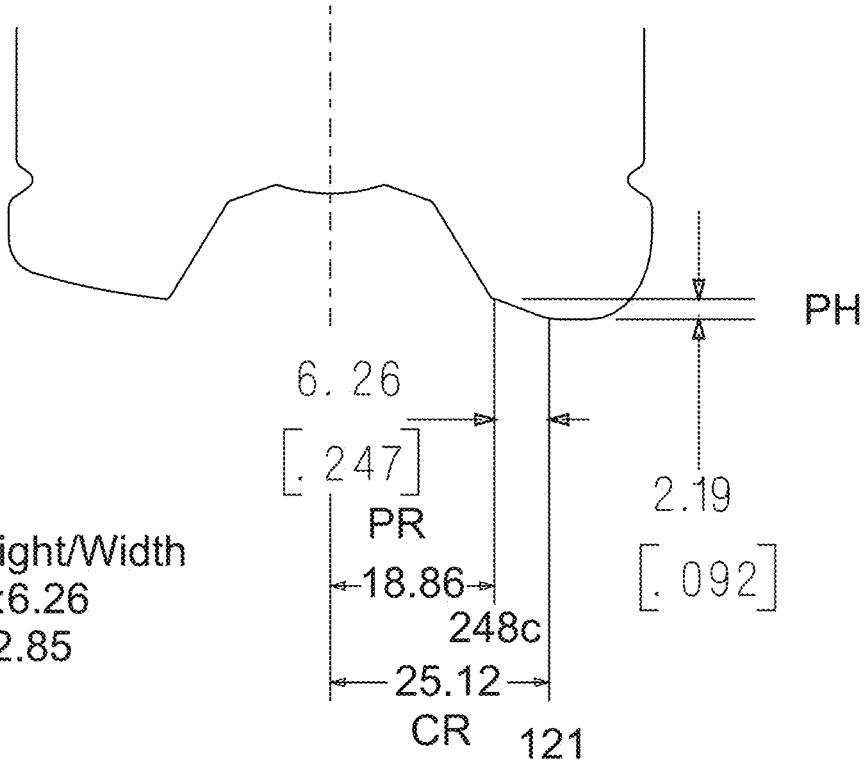
FIG. 9D is a cross-sectional view of the base of FIG. 9C rolling out under internal heated pressure.
Figure 10A:
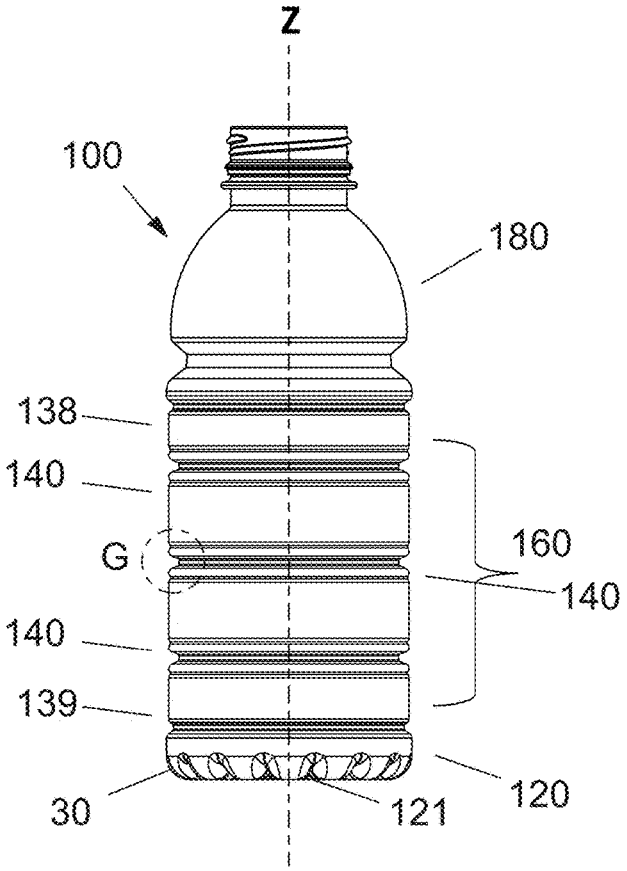
FIG. 10A is a side view of a beverage container constructed and operative in accordance with another embodiment of the invention.
Figure 10B:
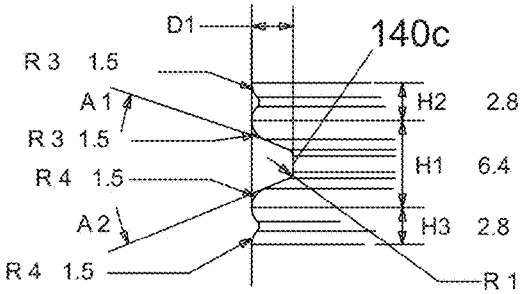
FIG. 10B is an enlarged view of a horizontal channel of the beverage container of FIG. 10A.
Figure 10C:
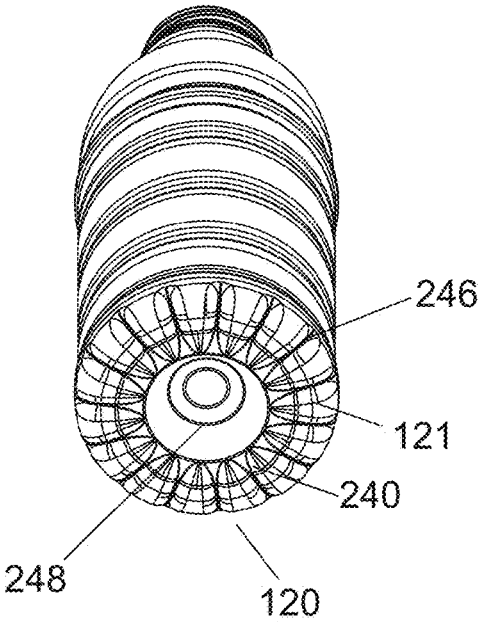
FIG. 10C is an isometric view of the beverage container of FIG. 10A.
Figure 10D:
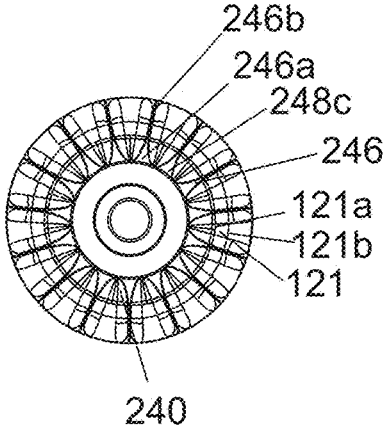
FIG. 10D is a bottom view of the beverage container of FIG. 10A.

With reference to FIGS. 9C and 9D, in order to further protect against the base from rolling out beyond the contact surface under raised internal pressure in such a way as described, a further embodiment of the present invention provides for the base of the push up to be preferably raised above the plane of the contact surface in the asblown container a distance sufficient to provide for the base to roll-out under a calculated high internal pressure to reduce material stress, but to not roll-out to the degree that vertical stability of the container is compromised.

In order to achieve this the base of the push up is configured to preferably have a Height Clearance Ratio (HCR) above the contact surface that can be expressed by way of the ratio PH (CR-PR) where PH is a measure of the height that the push up base 248*c* is above a plane of the contact surface 121, CR is the contact surface radius, and PR is the push up base radius. The container of the present invention most preferably has a HCR between about 1:10 and 1:1 in the as-molded container, where an instep structure joins both features relatively directly and the instep structure is upwardly directed from the contact surface. It is most preferable to achieve an HCR of between about 1:7 and 1:2.5 and the precise selection of suitable HCR for a given container requires consideration of the number of webs and footed portion structures, as these have an additional effect on base roll-out, and on further determining a configured amount of allowable outward base movement under positive internal pressure, while also providing for a configured amount of upward movement of the base in the presence of any subsequent vacuum pressure.

In previous known solutions, the base of the push up has often been joined firstly to a pressure panel that is then joined to an 'instep' feature having very aggressive vertical inclinations and whereby the push up base is not joined directly by the instep feature but instead by the intermediate vacuum panel that becomes the controlling structure for outward movement of the base under internal pressure and inward movement of the base push up in the presence of vacuum. In the present invention, the instep feature acts as both part of the pressure panel and instep and more directly controls base roll-out.

FIG. 9C shows one example of a suitable instep feature on a container having an HCR of about 1:7 where low-pressure filling is indicated, a percentage of PCR is in the order of approximately 25%, and good rib or channel construction is incorporated into the container that allows for suitable pressure relief by vertical expansion after capping and prior to cooling.

FIG. 9D shows an alternate construction where the HCR is increased to about 1:2.85 to favor increased protection against base roll-out in the event a higher percentage of PCR is anticipated. It is important to avoid increasing the HCR too much as there may be a negative impact on subsequent vacuum compensation and movement upward after cooling. A preferred range of HCR is between about 1:4 and 1:2.5, although HCR can be above or below either amount depending on channel expansion capability and filling methods applied.

It is an important aim of the present invention to provide annular ribbings or channels in a first configuration in an as-blown container that are generally vertically displaced through a majority of the vertical height of the container, particularly if the container comprises increased PCR. The annular ribbings or channels are configured to move to a second configuration by an increase in radius after filling with a heated liquid and capping in order to promote longitudinal expansion of the container and a reduction in internal overpressure—to prevent excess pressure being applied to the base. The channels are generally further configured to move to a third configuration by a reduction in radius under vacuum in order to reduce vacuum pressure and provide increased resistance to vacuum deformation in the radial or hoop direction.

A further embodiment of the present invention is disclosed in FIGS. 10A to 10D, wherein a container may be constructed to increase resistance to base roll-out and stress deformation under heated and pressurized conditions immediately post-filling, and prior to cooling, through the provision of an increased number of web structures in the base and another rib structure embodiment in the sidewall designed to exert more benefit in longitudinal expansion and vacuum compensation, top load and sideload denting. In the embodiment shown the rib or channel in the sidewall is constructed with a vertical flat 140*c* in the center of the overall rib structure. The vertical orientation provides increased top load characteristics over a radiused portion otherwise in the middle of the annulus, although a radius could be incorporated in another embodiment without departing from the scope of the invention. The rib structure generally comprises a collection of three channels—a smaller channel comprising an upper radius R3, and a lower radius R4 that joins and is shared with a larger middle channel, wherein the middle channel is offset deeper into the container sidewall than the upper channel. The middle channel has a lower radius R4, that is shared with another smaller channel below that provides another lower radius R4 on the lower border of the 'triple rib'. As can be seen, the triple-rib comprises three distinct height sections H1, H2 and H3.

The increased structure of the triple rib provides greater potential to expand in the longitudinal direction from a first as blown configuration to a second configuration when the container is hot filled and sealed through the increased number of radii incorporated into the rib or channel structure. The radii provide the capability to change or increase in radius and move to the second configuration more easily. The triple rib also provides greater potential to return to original height by contracting downwardly through a reduction in the increased number of radii in the rib structure. The height contraction adds to vacuum compensation performance and with the lowered vacuum pressure in the final container in a third configuration after cooling, there is a subsequent increase in top load in the container when sealed and stacked.

The triple rib also provides greater protection against sidewall deformation from side impacts thereby improving denting resistance and improving the condition of the container through the distribution channel.

Without departing from the scope of the invention, either the top channel or bottom layer channel can be removed from the triple rib to create a 'double rib', which although not as substantial and strong as a triple rib, still offers increased ability to expand longitudinally and contract longitudinally as discussed above.

In this particular embodiment, the base of the container is constructed with 15 webs and 15 footed portions. The construction of the webs in cross-section can be either the same as shown in FIGS. 9C or 9D, or another selection of ratios depending on the anticipated filling methodology and amount of incorporated PCR. With respect to the channel or rib structures, There are multiple advantages to increasing the number of webs beyond 4-5 in circular or mostly round containers especially. Firstly, the number of webs has a direct 'binding' correlation wherein the downwardly directed webs have a controlling restraint on downward movement of the push up portion.

Figure 11A:
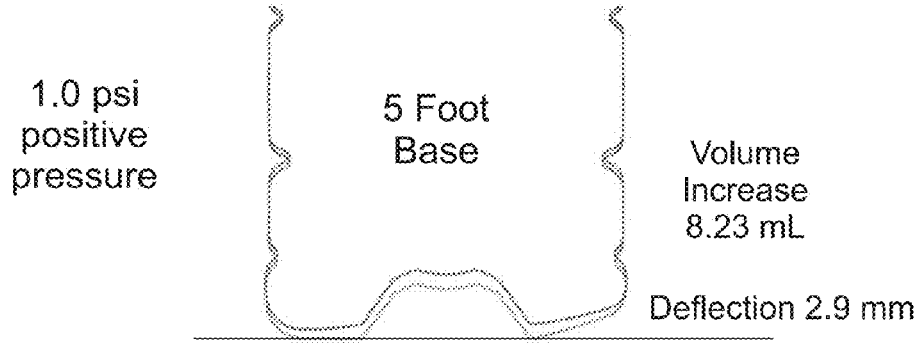
FIG. 11A illustrates a cross-sectional view of the overall longitudinal effect of increasing pressure within the beverage container of FIG. 14A after hot filling and capping.
Figure 11B:
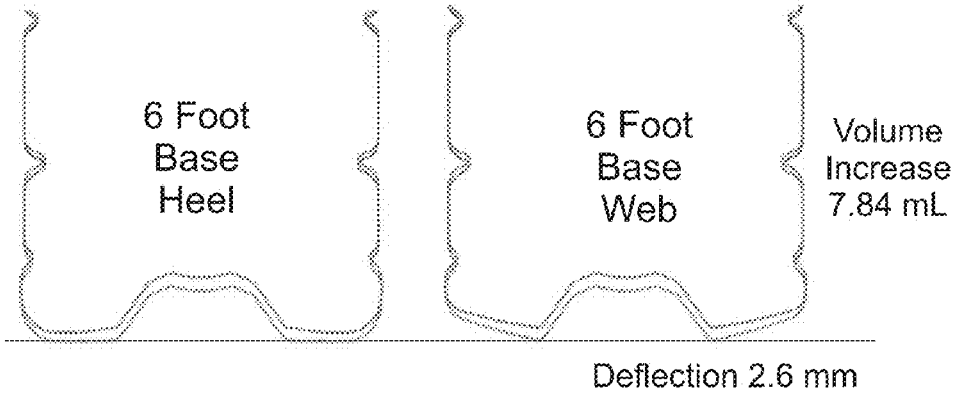
FIG. 11B illustrates a cross-sectional view of the overall longitudinal effect of increasing pressure within the beverage container of FIG. 15A after hot filling and capping.
Figure 11C:
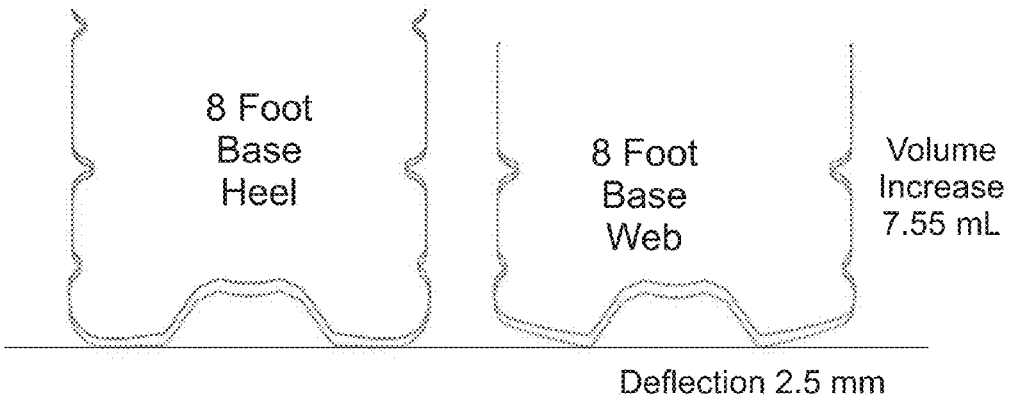
FIG. 11C illustrates a cross-sectional view of the overall longitudinal effect of increasing pressure within the beverage container of FIG. 16A after hot filling and capping.
Figure 11D:
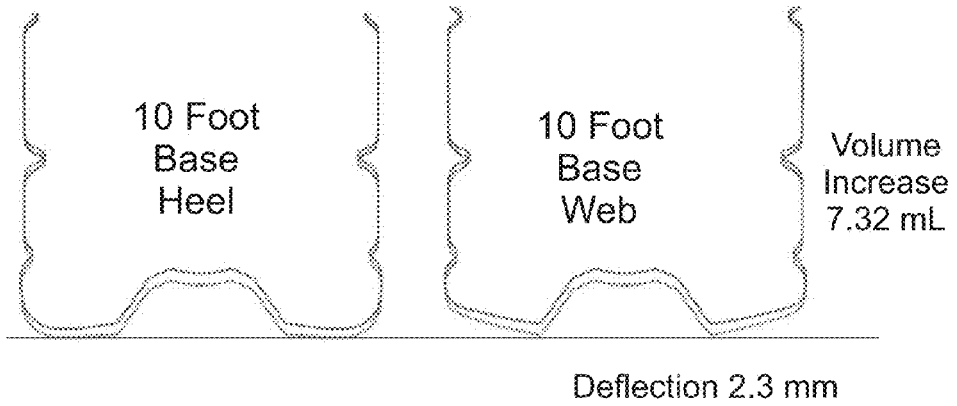
FIG. 11D illustrates a cross-sectional view of the overall longitudinal effect of increasing pressure within the beverage container of FIGS. 12A and 17A after hot filling and capping.
Figure 12A:
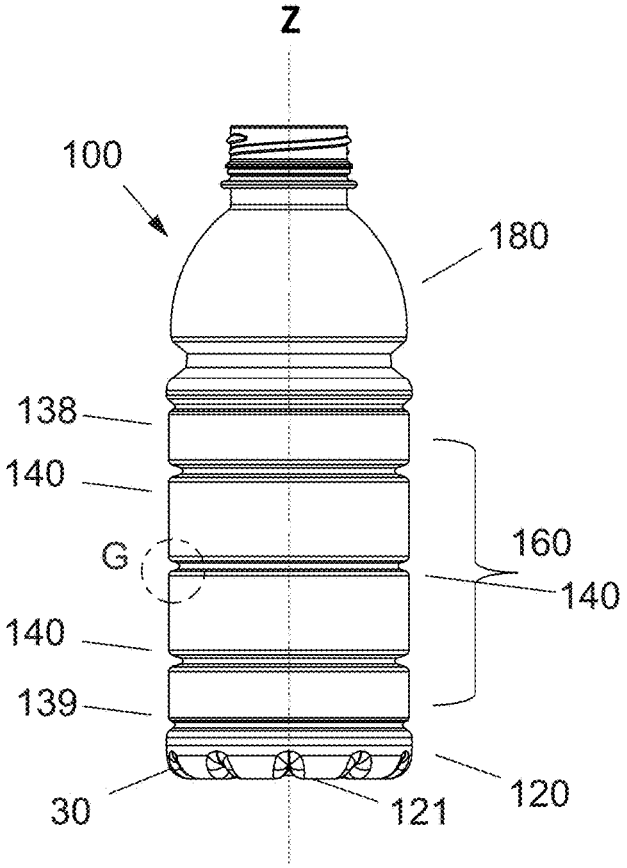
FIG. 12A is a side view of a beverage container constructed and operative in accordance with another embodiment of the invention.
Figure 12B:
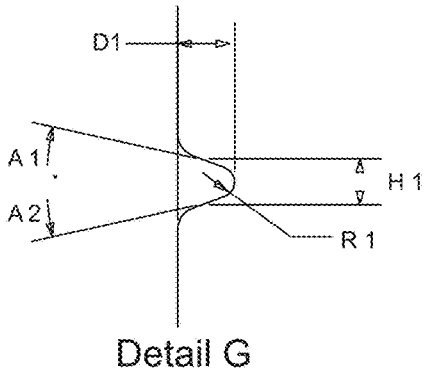
FIG. 12B is an enlarged view of a horizontal channel of the beverage container of FIG. 12A.
Figure 12C:
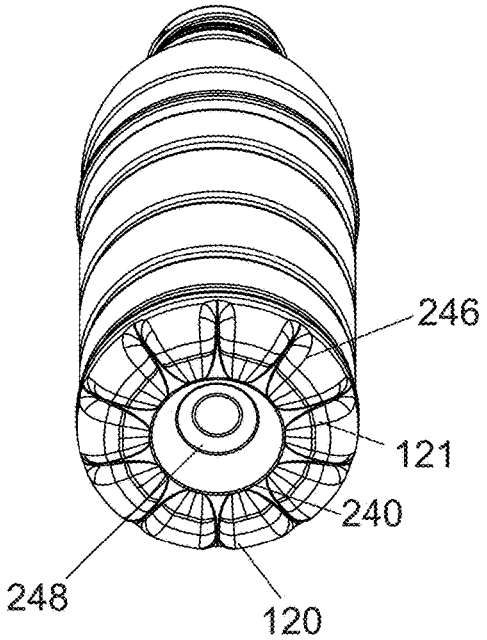
FIG. 12C is an isometric view of the beverage container of FIG. 12A.
Figure 12D:
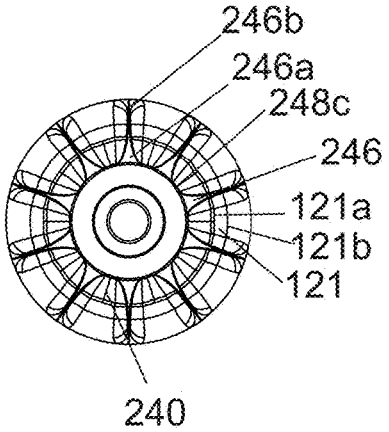
FIG. 12D is a bottom view of the beverage container of FIG. 12A.

With reference to FIGS. 11A to 11D, the more webs that are configured to restrain downward base movement, the less downward movement that occurs for a given internal pressure. This can be illustrated by way of Finite Element Analysis as reported in FIGS. 11A to 11D. A selection of containers comprising the same rib or channel structures, the same percentage of PCR, but varying number of webs and footed portions in a construction largely the same as the container in FIGS. 1A to 1F. It can be readily demonstrated in FIGS. 11A and 11B that by increasing the number of webs and footed portions from 5 to 6, there is a corresponding downward deflection of the base that is less and less of a volume increase under the same pressure. As demonstrated in FIGS. 11B and 11C, a further increase in web count to 8 provides additional reduction in corresponding downward deflection of the base. FIG. 11D demonstrates further reduction in downward deflection when 10 webs are incorporated in the base structure.

As the internal pressure under hot fill is relatively predictable, then in the presence of increased amounts of PCR, and particularly over 25% PCR, it is most desirable to incorporate at least 7 webs within the base structure, and more preferably 10 webs and footed portions, as shown in FIGS. 12A to 12D. As PCR increases it becomes advantageous to increase the number of webs to a greater number, wherein the number of webs could be up to, or even exceeding 15 web structures, although significant advantage beyond about 16 webs is unlikely to occur. With an increase in the number and amount of web structures there is a corresponding increase in resistance to heat induced deformation under stress that can otherwise occur, particularly in moveable bases incorporating even 25% PCR, but especially when anticipated PCR content exceeds about 35%. Thus, not only is base roll-out and the consequential effect on vertical stability compromised, but the potential for the base to be thermally distorted and then not function as designed after cooling is reduced greatly through the increased web structure preventing thermal distortion. Without sufficient web structure numbers, in very light weight bases with high PCR content the moveable parts of the base may be irreparably damaged through heat stress and become distorted from intended angular structures.

An additional advantage in employing greater than 5 webs in a typical container is the increased percentage of web structure surface area that increases the total surface area contained within the base.

A further embodiment of the present invention is disclosed in FIGS. 12A to 12D wherein a container may be constructed to increase resistance to base roll-out and stress deformation under heated and pressurized conditions immediately post-filling, and prior to cooling, through the provision of an increased number of web structures designed to exert more benefit in longitudinal expansion and vacuum compensation. In this particular embodiment, the container is constructed with 10 webs and 10 footed portions. The construction of the webs in cross-section can be either the same as shown in FIGS. 9C or 9D, or another selection of ratios depending on the anticipated filling methodology and amount of incorporated PCR.

Figure 13A:
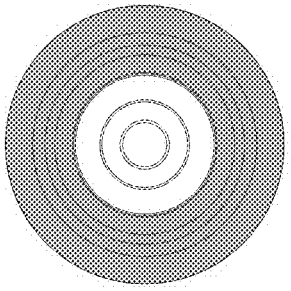
FIG. 13A is a bottom view of a beverage container showing a base constructed and operative in accordance with an embodiment of the present invention.
Figure 13B:
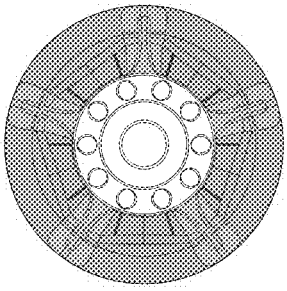
FIG. 13B is a bottom view of a beverage container showing a base constructed and operative in accordance with another embodiment of the present invention.
Figure 13C:
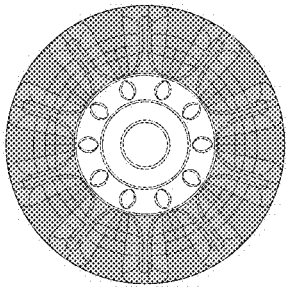
FIG. 13C is a bottom view of a beverage container showing a base constructed and operative in accordance with another embodiment of the present invention.
Figure 14A:
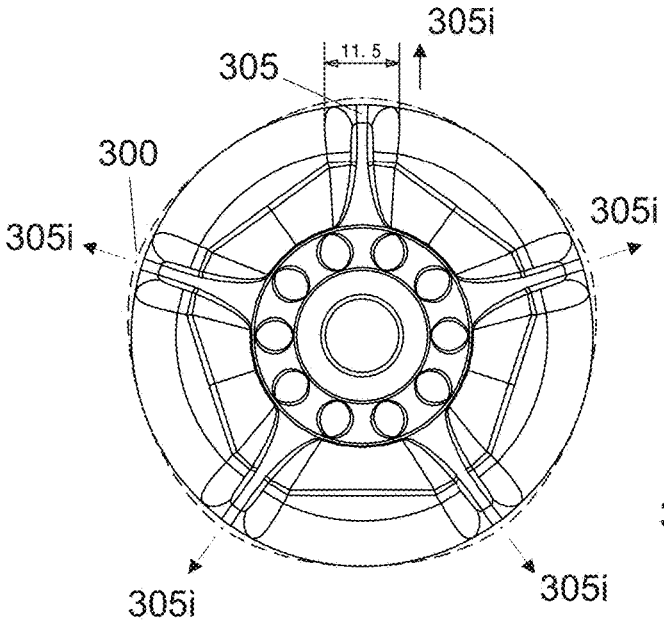
FIG. 14A is a bottom view of the beverage container of FIGS. 1A-1F showing the base constructed and operative in accordance with another embodiment of the present invention.
Figure 14B:
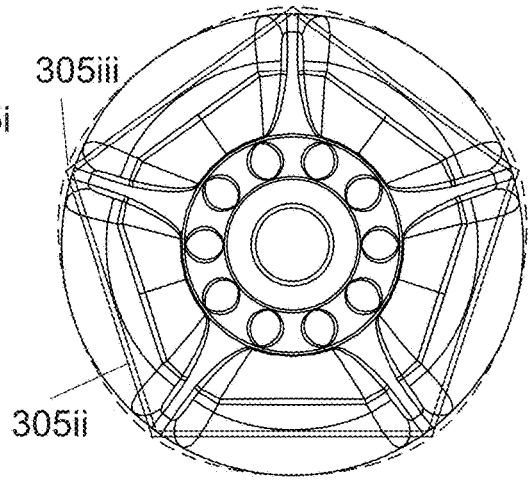
FIG. 14B is a bottom view of a beverage container of FIG. 14A showing the base constructed and operative in accordance with another embodiment of the present invention.

With reference to FIGS. 13A to 13C where largely identical base structures are shown, but having varying number of webs and footed portions, it will be seen by way of example only that the surface area of the base structure is increased by a percentage and moreover there is increased bending and vertical shaping of the plastic material during blow-molding such that the web structures are dimensionally stretched more during forming and this has a positive effect on the crystallinity in the as molded base. Increasing the number of webs from zero to 5 and then to 10, increases the available surface area of the base and the further increase in structural shaping with increasing structures further increases induced crystallinity and strength in lightweight bases. Further, the increased surface area along with the increased stretched integrity and crystallinity provides for far greater heat resistance and heat dissipation and dispersal during the time being conveyed from the filler to the cooler when there is high pressure and heat within the container that exceeds 75 degrees C. and the Tg of the plastic material.

A base comprising 15 webs and 15 footed portions for example has far greater heat radiation capabilities than a base with only 5 webs and 5 footed portions with subsequently less surface area. The heat absorption qualities of such structures are highly prized in lightweight moveable bases designed to incorporate amounts of PCR, and particularly amounts between about 25% to 50%, and virtually demanded for amounts of PCR beyond about 50% within the base in high pressure filling situations.

A further benefit of employing multiple web and footed portion structures is illustrated in FIGS. 14A to 14D. Typically, under vacuum conditions, the base structures are required to move upwardly to reduce the increasing vacuum pressure within a container. As this occurs the web portions 305 joining the sidewall will typically move from a first generally downward orientation to a second more upward or horizontally inclined orientation. As the web portions become more horizontally aligned the web length becomes greater in the transverse or horizontal plane under increasing vacuum pressure and the outer portions of the webs effectively move horizontally outward as indicated by arrows 305*i*. This causes a transverse 'polygonalization' of the circumferential shape of the heel of the container as indicated by 305*ii* in FIG. 14B being a representative view of the polygonalization of the base of FIG. 14A.

In one embodiment, the 5-web base is predicted to form a pentagonal shape 305*ii* under vacuum at the vertical level of the web junction with the sidewall and this causes an increase in the 'effective diameter' 300 of the container at the points of the pentagon 305*iii*. During processing of the container and in particular during labelling of the container post-cooling, the polygonalization of the heel or chime portion of the container can become non-round therefore. Label base plates are generally required to hold the heel or chime portion of the container in place for stability of the container during label application, and the close contact of the base plate and the container is required to ensure rapid and smooth label application. As the exiting temperature of the container from the cooler is not an exact science, the amount of vacuum experienced within containers may vary from day to day, and therefore the 'tightness' of the bottle within the label base plates may also vary from day to day.

In other preferred embodiments of the present invention, and with reference to FIGS. 13A to 13C, there is provided an increased number of webs and footed portions configured to increase number of 'sides' to the potential polygon shapes expected to form during cooling. As the number of webs is increased, there is increased movement of the polygon towards an effective cylindrical shape, and a resulting decreasing change in overall radius of the container—at the vertical height of the container expected to be held within label base plates. For example, a base according the present invention having 5 webs may have a web area to overall non-web area of about 1:2.48. Under moderate vacuum conditions expected at about labelling time, where the temperature of the liquid is expected to be above ambient temperature and usually in the range of about 35-40 degrees C., the container may experience an effective increase in radius at the junction of each web with the sidewall of about 1.9%.

As the number of web structures is increased the effective polygonalization of the vacuum deformed base is increased, and this causes preferentially less radial deformation at the junctions of the web structures with the sidewalls.

Figure 15A:
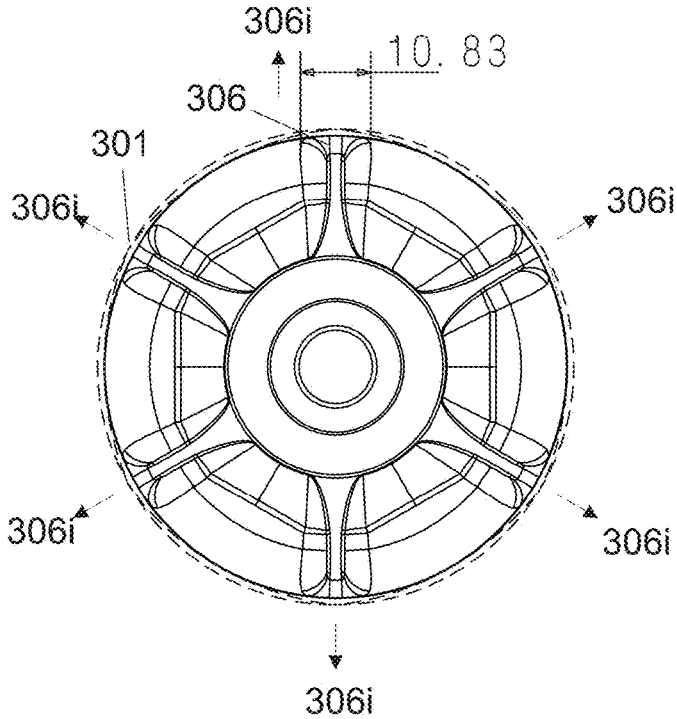
FIG. 15A is a bottom view of a beverage container showing a base constructed and operative in accordance with another embodiment of the present invention.
Figure 15B:
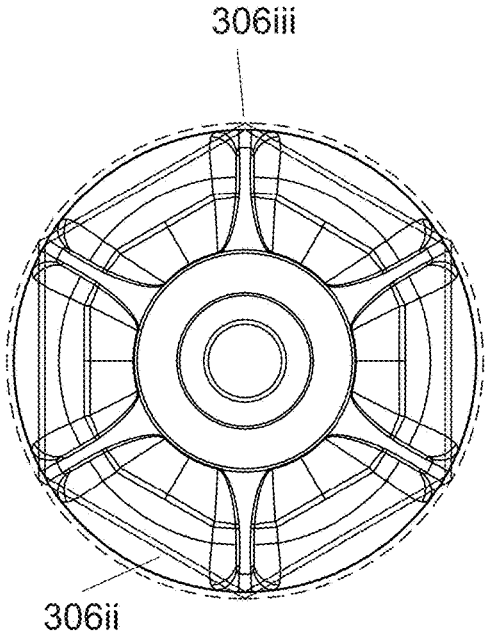
FIG. 15B is a bottom view of the beverage container of FIG. 15A showing the base constructed and operative in accordance with another embodiment of the present invention.

With reference to FIGS. 15A and 15B, an increase in the number of web structures 306 by an additional web results in an effective polygonalization of the base at the time of labeling and may result in less movement of the junction of each web with the sidewall, indicated by arrows 306*i*, that is less than in a 5 web base structure. An effective hexagonal shape 306*ii* may occur in this embodiment with a resulting increase in effective radius 301 at the junction of each web with the sidewall at the points of the hexagon 306*iii* that is less than 300. By way of example a base according the present invention having 6 webs may have a web area to overall non-web area of about 1:1.89, although this can be altered in other preferential embodiments where each web area is maintained in size causing a greater ratio of web area. Under moderate vacuum conditions expected at about labelling time, where the temperature of the liquid is expected to be above ambient temperature and usually in the range of about 35-40 degrees C., the container may experience an effective increase in radius at the hexagonal junction of each web with the sidewall of about only 1.7%.

Figure 16A:
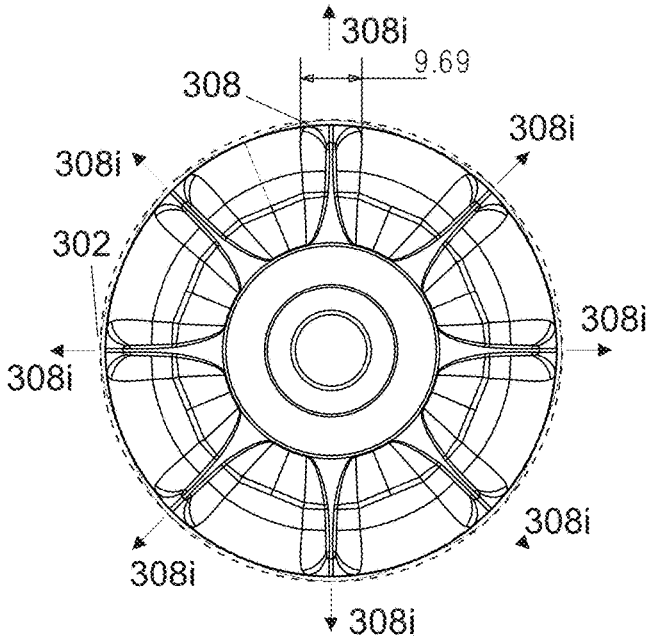
FIG. 16A is a bottom view of a beverage container showing a base constructed and operative in accordance with another embodiment of the present invention.
Figure 16B:
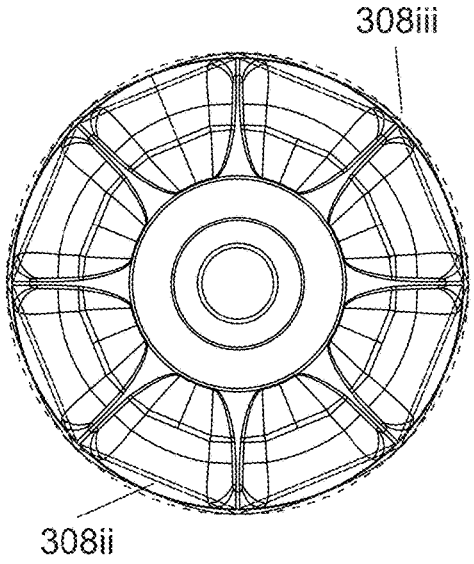
FIG. 16B is a bottom view of the beverage container of FIG. 16A showing the base constructed and operative in accordance with another embodiment of the present invention.

With reference to FIGS. 16A and 16B, an increase in the number of web structures 308 by an additional 2 webs results in an effective polygonalization of the base at the time of labeling and may result in less movement of the junction of each web with the sidewall, indicated by arrows 308*i*, that is less than in a 5 or 6 web base structure. An effective octagonal shape 308*ii* may occur in this embodiment with a resulting increase in effective radius 302 at the junction of each web with the sidewall at the points of the octagon 308*iii* that is less than 300 or 301 in the 5 web or 6 web containers respectively. By way of example a base according the present invention having 8 webs may have a web area to overall non-web area of about 1:1.35, although this also can be altered in other preferential embodiments where each web area is maintained in size causing a greater ratio of web area. Under moderate vacuum conditions expected at about labelling time, where the temperature of the liquid is expected to be above ambient temperature and usually in the range of about 35-40 degrees C., the container may experience an effective increase in radius at the octagonal junction of each web with the sidewall of about only 1.3%.

Figure 17A:
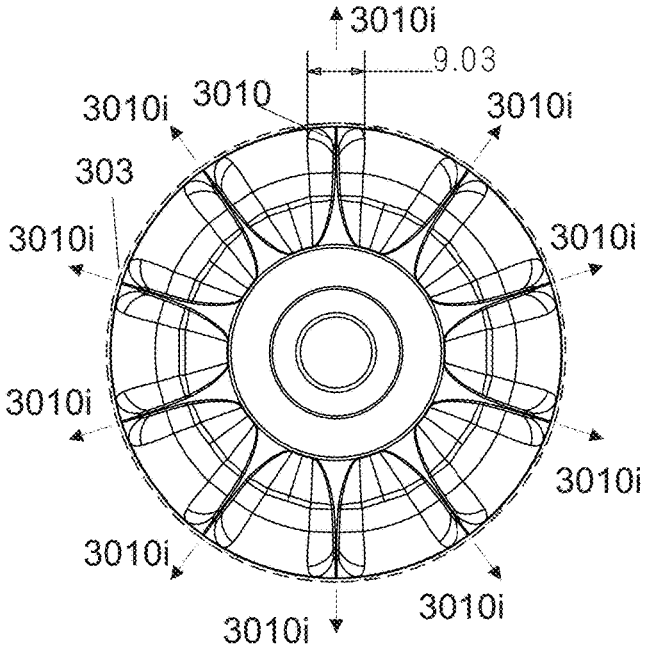
FIG. 17A is a bottom view of the beverage container of FIG. 12A showing the base constructed and operative in accordance with another embodiment of the present invention; and, FIG. 17B is a bottom view of the beverage container of FIG. 12A showing the base constructed and operative in accordance with another embodiment of the present invention.
Figure 17B:
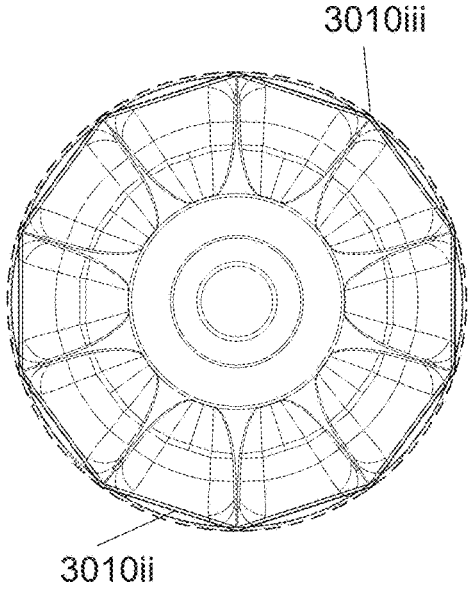

With reference to FIGS. 17A and 17B, an increase in the number of web structures 3010 by an additional 2 webs results in an effective polygonalization of the base at the time of labeling and may result in less movement of the junction of each web with the sidewall, indicated by arrows 3010*i*, that is less than in the 8 web base structure. An effective decagonal shape 3010*ii* may occur in this embodiment with a resulting increase in effective radius 303 at the junction of each web with the sidewall at the points of the decagon 3010*iii* that is less than 302 in the 8 web container. By way of example a base according the present invention having 10 webs may have a web area to overall non-web area of about 1:0.97, although this also can be altered in other preferential embodiments where each web area is maintained in size causing a greater ratio of web area. Under moderate vacuum conditions expected at about labelling time, where the temperature of the liquid is expected to be above ambient temperature and usually in the range of about 35-40 degrees C., the container may experience an effective increase in radius at the decagonal junction of each web with the sidewall of about only 1.2%.

In other embodiments of the present invention employing 15 or greater webs provides a base that is close to circular in effect during the range of temperatures expected at or about labelling time, and therefore providing for more control of the labeling process altogether.

It is a particular aim of the present invention, therefore, to provide a container having a high percentage of PCR, that provides greater strength and control against sidewall ovalization under hot fill vacuum deformation force through the addition of channels and ribbings configured to move interactively during hot fill with a moveable base as described herein. Preferentially, the moveable base comprises very few, if any, ribbing structures and is comprised mainly of web portions extending from the sidewall to a push up portion, between footed contact surfaces. By eliminating most other geometry, especially strengthening ribs, the base is made highly mobile and capable of extending outwardly and inwardly, in cooperation with a sidewall that is configured to move upwardly and downwardly as the container pressure increases and decreases.

It is a further aim of the present invention to provide such cooperating sidewall and base configurations in containers having greater than 20-25% PCR, or preferably more than 50%, 75% and to even provide for containers of such configurations having 100% PCR material in the sidewalls. As the percentage of PCR increases and reduces the strength and integrity of prior art sidewalls, the improved channel configurations provide a necessary increase in inherent strength to enable use of high PCR amount.

It is yet another aim of the present invention to provide for improved configuration in sidewalls of containers, particularly those incorporating high percentages of PCR to provide for light-weighting of the sidewalls through the increased strength offered by the channels as herein described.

It is yet another aim of the present invention to provide channel configurations as herein described that allow for increased PCR content preferably above 20-25%, that increase top load values and reduce compression of the container under hot vented situations and hot filled and sealed situations, and reduce the amount of stretch that containers may experience during neck supported hot filling, and also reduce the amount of compression that containers may experience during base supported hot filling in order to reduce the differentials between container heights blow-molded to the same specifications but filled on different filling systems.

It is a further aim of the present invention to combine the sidewall structures disclosed herein with the vacuum base structures disclosed or incorporated within U.S. patent application Ser. Nos. 15/284,622, 15/581,855, 16/304,942, 17/090,611, 17/260,475, and 17/423,353-all of which are incorporated herein by reference in their entireties.

Example Embodiments

The following is a numbered list of example embodiments that are within the scope of this disclosure. The example embodiments that are listed should in no way be interpreted as limiting the scope of the embodiments. Various features of the example embodiments that are listed can be removed, added, or combined to form additional embodiments, which are part of this disclosure:

1. A beverage container, comprising:
   a base; a cylindrical sidewall extending from and integrally formed with the base;
   an upper region extending from the cylindrical sidewall and defining an upper opening, wherein the beverage container comprises a longitudinal axis extending in a direction from the base to the upper opening; and
   a plurality of continuous channels having a first as molded channel configuration formed in and extending around a circumference of the cylindrical sidewall, wherein the continuous channels are configured to resist vacuum compression in the radial or transverse direction of the beverage container; and
   wherein the base includes an outer wall portion extending from the lower end of the sidewall to a plurality of discontinuous footed contact surfaces for supporting the container and a plurality of webs extending continuously from the sidewall radially along the base portion toward the longitudinal axis in the transverse direction to join a push up portion, wherein each one of the webs define a web surface that is closer to the finish than the plurality of footed contact surfaces and comprises a generally downward and continuous surface from the sidewall to the push up portion, further wherein the base includes inner wall portions extending alternately upward from the contact surfaces and downward from the webs; and
   wherein after hot filling and capping and prior to cooling the sidewall and base are configured to move interactively and in differential amounts under changing pressure conditions, wherein the sidewall is configured to expand longitudinally from a first unpressurized configuration to a second pressurized configuration, and the base portion is configured to move to a different extent longitudinally from a first unpressurized configuration to a second pressurized configuration; and
   wherein after cooling the sidewall is configured to contract longitudinally to a third pressurized configuration, and the base is configured to move to a different extent to a third pressurized configuration, wherein a vacuum exists within the container.
2. The container of embodiment 1, wherein the third pressurized configuration of the sidewall is substantially the same as the first unpressurized configuration.
3. The container of embodiment 2, wherein the third pressurized configuration of the base is substantially different to the first unpressurized configuration.
4. The container of embodiment 1, wherein the continuous channel is configured to move under longitudinal compression of the container and increase top load.
5. The container of embodiment 1 or 4, wherein the continuous channel is configured to provide for a calculated amount of elongation in the longitudinal direction under an applied internal pressure.
6. The container of embodiment 5, wherein the container comprises about 25% PCR.
7. The container of embodiment 5, wherein the container comprises more than about 25% PCR.
8. The container of embodiment 5, wherein the container comprises 3 continuous channels.
9. The container of embodiment 1, wherein the container comprises 4 or more continuous channels.
10. The container of embodiment 1, wherein at least one web comprises a compound curve angled downwardly from the sidewall to the push up.
11. The container of embodiment 1, wherein the base is relatively free of additional rib elements or structure.
12. The container of embodiment 1, wherein after hot filling and capping, a vacuum is created following the cooling of the liquid contents.
13. The container of embodiment 12, wherein after releasing the vacuum the sidewall moves to a fourth unpressurized configuration and the base moves to a fourth unpressurized configuration.

The term 'comprising' as used in this specification and claims means 'consisting at least in part of' or 'including, but not limited to' such that it is to be construed in an inclusive sense as opposed to an exclusive or exhaustive sense. When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

The term 'and/or' means 'and' or 'or', or both. The use of '(s)' following a noun means the plural and/or singular forms of the noun.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

In the above description, specific details are given to provide a thorough understanding of the embodiments. However, it will be understood by one of ordinary skill in the art that the embodiments may be practiced without these specific details.

Although this disclosure has been described in the context of certain embodiments and examples, it will be understood by those skilled in the art that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art. It is also contemplated that various combinations or sub-combinations of the specific features and aspects of the embodiments may be made and still fall within the scope of the disclosure. For example, features described above in connection with one embodiment can be used with a different embodiment described herein and the combination still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment of the invention disclosed herein.

This disclosure may also be said broadly to consist in the parts, elements and features referred to or indicated in this disclosure, individually or collectively, and any or all combinations of any two or more said parts, elements or features, and where specific integers are mentioned herein which have known equivalents in the art to which this disclosure relates, such known equivalents are deemed to be incorporated herein as if individually set forth.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

The scope of the present disclosure is not intended to be limited by the specific disclosures of embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A beverage container, comprising:

a base;

a cylindrical sidewall extending from and integrally formed with the base;

an upper region extending from the cylindrical sidewall and defining an upper opening, wherein the beverage container comprises a longitudinal axis extending in a direction from the base to the upper opening; and a plurality of continuous channels having a first as molded channel configuration formed in and extending around a circumference of the cylindrical sidewall, wherein the continuous channels are configured to resist vacuum compression in the radial or transverse direction of the beverage container; and wherein the base includes an outer wall portion extending from the lower end of the sidewall to a plurality of discontinuous footed contact surfaces for supporting the container and a plurality of webs extending continuously from the sidewall radially along the base portion toward the longitudinal axis in the transverse direction to join a push up portion, wherein each one of the webs define a web surface that is closer to the finish than the plurality of footed contact surfaces and comprises a downward and continuous surface from the sidewall to the push up portion, further wherein the base includes inner wall portions extending alternately upward from the contact surfaces and downward from the webs; and wherein after hot filling and capping and prior to cooling the sidewall and base are configured to move interactively and in differential amounts under changing pressure conditions, wherein the sidewall is configured to expand longitudinally from a first unpressurized configuration to a second pressurized configuration, and the base portion is configured to move to a different extent longitudinally from a first unpressurized configuration to a second pressurized configuration; and wherein after cooling the sidewall is configured to contract longitudinally to a third pressurized configuration, and the base is configured to move to a different extent to a third pressurized configuration, wherein a vacuum exists within the container.

2. The container of claim 1, wherein the third pressurized configuration of the sidewall is substantially the same as the first unpressurized configuration.

3. The container of claim 2, wherein the third pressurized configuration of the base is substantially different to the first unpressurized configuration.

4. The container of claim 1, wherein the plurality of continuous channels is configured with a vertical flat in a center of an overall rib structure to move under longitudinal compression of the container and increase top load.

5. The container of claim 4, wherein the plurality of continuous channels is configured to provide for a calculated amount of elongation in the longitudinal direction under an applied internal pressure.

6. The container of claim 4, wherein the container comprises 4 or more continuous channels.

7. The container of claim 4, wherein at least one web comprises a compound curve angled downwardly from the sidewall to the push up.

8. The container of claim 4, wherein the base is relatively free of additional rib elements or structure.

9. The container of claim 1, wherein the container comprises about 25% PCR.

10. The container of claim 1, wherein the container comprises more than about 25% PCR.

11. The container of claim 1, wherein the container comprises 4 or more continuous channels.

12. The container of claim 1, wherein at least one web comprises a compound curve angled downwardly from the sidewall to the push up.

13. The container of claim 12, wherein the base is relatively free of additional rib elements or structure.

14. The container of claim 1, wherein the base is relatively free of additional rib elements or structure.

15. The container of claim 14, wherein the plurality of continuous channels is configured to provide for a calculated amount of elongation in the longitudinal direction under an applied internal pressure.

16. The container of claim 15, wherein the container comprises 3 continuous channels.

17. The container of claim 14, wherein after hot filling and capping, a vacuum is created following the cooling of the liquid contents.

18. The container of claim 1, wherein after hot filling and capping, a vacuum is created following the cooling of the liquid contents.

19. The container of claim 18, wherein after releasing the vacuum the sidewall moves to a fourth unpressurized configuration and the base moves to a fourth unpressurized configuration.

* * * * *